US010103417B2

(12) United States Patent
Gomberg

(10) Patent No.: US 10,103,417 B2
(45) Date of Patent: Oct. 16, 2018

(54) WAVEGUIDE HINGE

(71) Applicant: Space Systems/Loral, LLC, Palo Alto, CA (US)

(72) Inventor: Evan I. Gomberg, San Mateo, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 215 days.

(21) Appl. No.: 14/995,070

(22) Filed: Jan. 13, 2016

(65) Prior Publication Data

US 2017/0200997 A1 Jul. 13, 2017

(51) Int. Cl.

| | |
|---|---|
| ***H01P 1/12*** | (2006.01) |
| ***H01P 1/06*** | (2006.01) |
| ***H01Q 1/28*** | (2006.01) |
| ***H01P 5/12*** | (2006.01) |

(52) U.S. Cl.

CPC ..... *H01P 1/122* (2013.01); *H01P 1/062* (2013.01); *H01P 1/064* (2013.01); *H01P 5/12* (2013.01); *H01Q 1/288* (2013.01)

(58) Field of Classification Search

CPC .. H01P 1/062; H01P 1/064; H01P 5/12; H01P 1/12; H01P 1/122; H01C 1/288

USPC ..... 333/105, 106, 108, 254, 256, 258, 259

See application file for complete search history.

(56) References Cited

U.S. PATENT DOCUMENTS

| | | | | |
|---|---|---|---|---|
| 2,420,007 | A * | 5/1947 | Olden | H01P 1/064 333/256 |
| 2,737,633 | A | 3/1956 | Kiyo | |
| 2,945,193 | A * | 7/1960 | Strom | H01P 1/068 333/106 |
| 4,117,426 | A | 9/1978 | Hudspeth et al. | |
| 4,242,652 | A | 12/1980 | Shishido et al. | |
| 5,206,610 | A * | 4/1993 | Nelson | H01P 1/122 333/106 |
| 5,471,177 | A * | 11/1995 | Hudspeth | H01P 1/2138 333/126 |
| 6,448,869 | B1 * | 9/2002 | Kich | H01P 1/122 333/106 |
| 8,917,149 | B2 | 12/2014 | Blech et al. | |
| 2012/0093041 | A1 | 4/2012 | Takeda et al. | |

(Continued)

FOREIGN PATENT DOCUMENTS

| | | |
|---|---|---|
| EP | 2544296 | 1/2013 |
| FR | 2822592 | 9/2002 |

OTHER PUBLICATIONS

International Search Report and Written Opinion dated Apr. 21, 2017, in PCT Application No. PCT/US2017/013202.

(Continued)

*Primary Examiner* — Robert J Pascal
*Assistant Examiner* — Jorge Salazar, Jr.
(74) *Attorney, Agent, or Firm* — Weaver Austin Villeneuve & Sampson LLP

(57) ABSTRACT

Waveguide hinges are provided that allow for a substantially continuous RF waveguide to be formed through the hinge when the hinge elements are in a particular relative rotational configuration with respect to one another; the substantially continuous RF waveguide is not formed when the hinge elements are in various other relative rotational configurations. Such waveguide hinges allow for waveguide elements to be repositioned during periods when RF energy is not being transmitted.

22 Claims, 14 Drawing Sheets

(56) References Cited

U.S. PATENT DOCUMENTS

| | | | |
|---|---|---|---|
| 2012/0235882 | A1 | 9/2012 | Iverson et al. |
| 2014/0152492 | A1 | 6/2014 | Zimmerman et al. |
| 2015/0130565 | A1 | 5/2015 | Henderson et al. |

OTHER PUBLICATIONS

International Preliminary Report on Patentability dated Jul. 26, 2018, in PCT Application No. PCT/US2017/013202.

* cited by examiner

First RF Waveguide Portions 1510A-D

Second RF Waveguide Portions 1512A-D

Overlap of First and Second RF Waveguide Portions

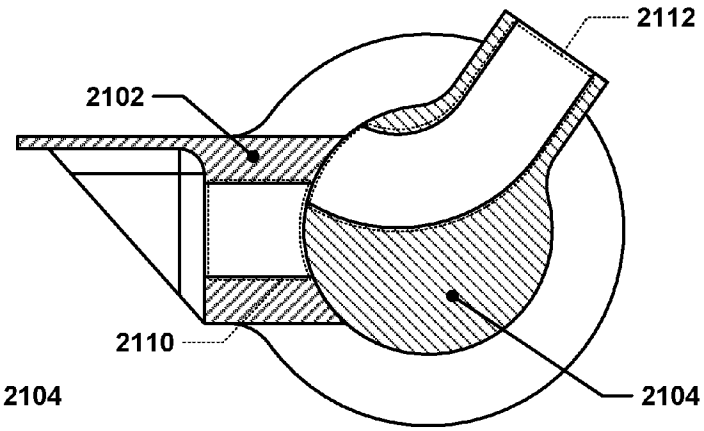
Figure 25
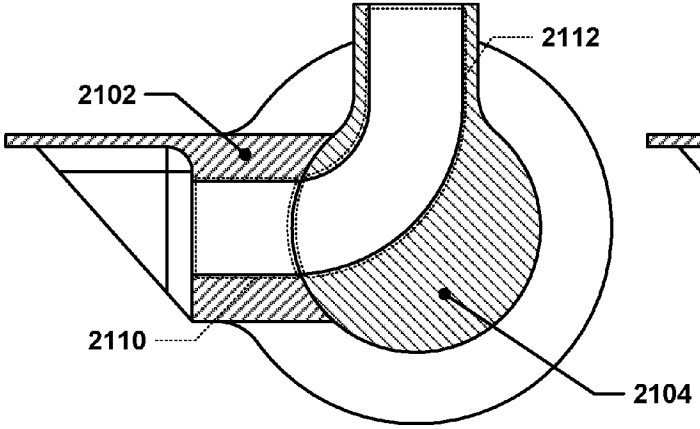
Figure 26
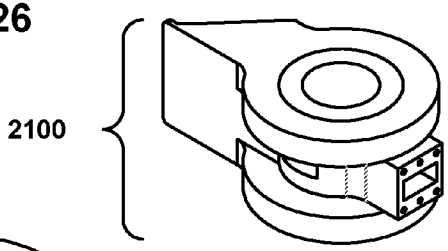
Figure 29
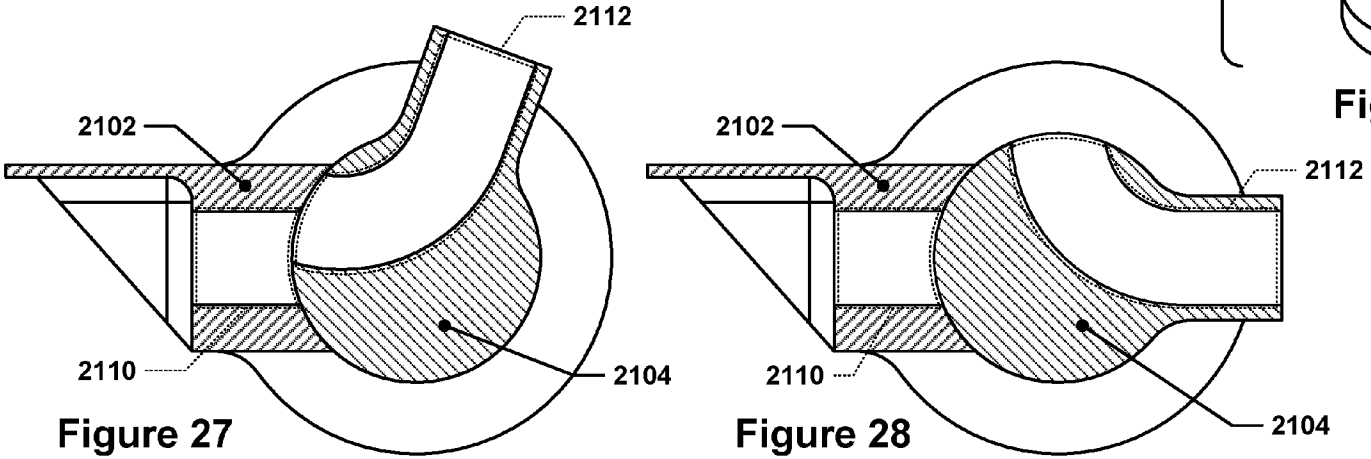
Figure 27
Figure 28

WAVEGUIDE HINGE

TECHNICAL FIELD

This disclosure relates generally to hinge mechanisms incorporating radio frequency waveguides. More particularly, this disclosure relates to hinge mechanisms that may be used in the context of satellite or spacecraft systems, although the concepts discussed herein are not limited to such applications.

BACKGROUND

The assignee of the present disclosure manufactures and deploys spacecraft for, inter alia, communications and broadcast services. Such spacecraft may employ one or more radio-frequency (RF) communications systems. Such RF communications systems may include one or more waveguides that may be used to guide RF waves from one location, such as an RF transmitter, to another location, such as an antenna feed.

Waveguides are usually rigid or flexible conduits having particular cross-sectional characteristics. For example, a waveguide for use with microwave RF signals may be a metal tube with a rectangular cross-section. One or more rigid or flexible waveguides may be connected to one another, either directly or via intermediary RF components, in order to provide an RF system.

SUMMARY

The present inventor has appreciated that a hinge incorporating an RF waveguide may allow for increased flexibility with respect to maintaining and using RF systems. The present inventor has further appreciated that such a hinge may be constructed such that portions of the hinge may be transitioned between at least two different configurations—a first relative rotational configuration and a second relative rotational configuration. In the first relative rotational configuration, two RF waveguide portions, each located in a different portion of the hinge, may be aligned with one another within the hinge such that a substantially continuous waveguide is formed through the hinge. In the second relative rotational configuration, the two RF waveguide portions may be misaligned with one another such that the substantially continuous waveguide ceases to exist.

In some implementations, an apparatus may be provided. The apparatus may include a first member, a second member, a first radio-frequency (RF) waveguide portion located in the first member, and a second RF waveguide portion located in the second member. The first member and the second member may be rotatably coupled with one another relative to a rotational axis, thereby forming a hinge, and may be transitionable between a first relative rotational configuration and a second relative rotational configuration. In the first relative rotational configuration, the first RF waveguide portion and the second RF waveguide portion may be aligned with one another to form a first waveguide through the first member and the second member, and in the second relative rotational configuration, the first RF waveguide portion and the second RF waveguide portion may not be aligned with one another to form the first waveguide through the first member and the second member.

In some such implementations, the first RF waveguide portion may enter the first member along a direction substantially parallel to a first axis that is perpendicular to the rotational axis, and the second RF waveguide portion may exit the second member along a direction substantially parallel to a second axis that is also perpendicular to the rotational axis.

In some other such implementations, the first RF waveguide portion may enter the first member along a direction substantially parallel to a first axis that is perpendicular to the rotational axis, and the second RF waveguide portion may exit the second member along a direction substantially parallel to the rotational axis.

In some implementations of the apparatus, the first RF waveguide portion may enter the first member and the second RF waveguide portion may enter the second member along directions substantially parallel to the rotational axis.

In some implementations of the apparatus, the apparatus may further include a third RF waveguide portion located in the first member and a fourth RF waveguide portion located in the second member. In such implementations, the third RF waveguide portion and the fourth RF waveguide portion may be aligned with one another to form a second waveguide through the first member and the second member when the first member and the second member are in the first relative rotational configuration, and the third RF waveguide portion and the fourth RF waveguide portion may not be aligned with one another to form the second waveguide through the first member and the second member when the first member and the second member are in the second relative rotational configuration.

In some implementations, the first RF waveguide portion and the third RF waveguide portion may enter the first member along directions substantially parallel to a first axis that is perpendicular to the rotational axis, and the second RF waveguide portion and the fourth RF waveguide portion may exit the second member along directions substantially parallel to a second axis that is also perpendicular to the rotational axis.

In some implementations of the apparatus, the first RF waveguide portion and the third RF waveguide portion may enter the first member along directions substantially parallel to a first axis that is perpendicular to the rotational axis, the second RF waveguide portion may exit the second member along a direction that is substantially parallel to the rotational axis, and the fourth RF waveguide portion may exit the second member along a direction substantially parallel to a second axis that is perpendicular to the rotational axis.

In some implementations of the apparatus, the apparatus may further include a positive locking mechanism that engages when the first member and the second member are transitioned into the first relative rotational configuration and that prevents the first member and the second member from rotating relative to one another when engaged.

In some implementations of the apparatus, the apparatus may further include a drive mechanism that is configured to cause the apparatus to move from the second relative rotational configuration to the first relative rotational configuration. In some such implementations, the drive mechanism may be provided by a torsion spring, a linear spring, or a motor.

In some implementations, in the first relative rotational configuration, the first RF waveguide portion and the second RF waveguide portion may provide a first path for RF energy, and the first RF waveguide portion and the second RF waveguide portion may both have rectangular cross-sections in planes perpendicular to the first path that are substantially the same. In some further such implementations, the rectangular cross-sections may have an aspect ratio of between 1.8:1 and 2.2:1.

In some implementations of the apparatus, the apparatus may further include a plurality of first RF waveguide portions located in the first member and a plurality of second RF waveguide portions located in the second member. In such an implementation, each of the second RF waveguide portions may correspond to one of the first RF waveguide portions. Furthermore, in the first relative rotational configuration, each of the first RF waveguide portions and each of the corresponding second RF waveguide portions may be aligned with one another to form a corresponding substantially continuous waveguide through the first member and the second member, and in the second relative rotational configuration, each of the first RF waveguide portions and each of the second RF waveguide portions may not be aligned with one another to form the corresponding substantially continuous waveguide through the first member and the second member.

In some such implementations of the apparatus, one or more of the first RF waveguide portions may enter the first member along a direction substantially parallel to a first axis that is perpendicular to the rotational axis, and one or more of the second RF waveguide portions may exit the second member along a direction substantially perpendicular to a second axis that is also perpendicular to the rotational axis.

In some alternative such implementations of the apparatus, one or more of the first RF waveguide portions may enter the first member along a direction substantially parallel to a first axis that is perpendicular to the rotational axis, and one or more of the second RF waveguide portions may exit the second member along a direction substantially parallel to the rotational axis.

In some implementations of the apparatus, one or more of the first RF waveguide portions may enter the first member and one or more of the second RF waveguide portions may exit the second member along a directions substantially parallel to the rotational axis.

In some implementations of the apparatus, one or more of the first RF waveguide portions may enter the first member along a direction substantially parallel to a first axis that is perpendicular to the rotational axis, one or more of the second RF waveguide portions may exit the second member along a direction substantially parallel to a second axis that is also perpendicular to the rotational axis, and one or more of the second RF waveguide portions may exit the second member along a direction substantially parallel to the rotational axis.

In some implementations of the apparatus, the apparatus may further include a deployable boom having a distal end and a proximal end, a boom RF waveguide, and a spacecraft main body having a main body RF source. In such implementations, the proximal end of the deployable boom may be connected with the second member and the boom RF waveguide may be coupled with the second RF waveguide portion, the boom RF waveguide may extend from the proximal end of the deployable boom towards the distal end of the deployable boom, and the spacecraft main body may be connected with the first member and the main body RF source may be coupled with the first RF waveguide portion. Furthermore, the first member and the second member may be configured to allow the deployable boom to be rotated about the rotational axis from a stowed configuration to a deployed configuration such that the first member and the second member are in the first relative rotational configuration in the deployed configuration and in the second relative rotational configuration in the stowed configuration.

In some implementations, the apparatus may further include a first RF routing panel and a spacecraft main body. The first RF routing panel may be mounted on or within the main body, the hinge formed by the first member and the second member may be configured to allow the first RF routing panel to be rotated relative to the main body, and, in the first relative rotational configuration, the first RF routing panel may be in a configuration in which RF components mounted to the first RF routing panel are operable to route RF power and the first waveguide is configured to route RF power from or to a first RF component of the RF components mounted to the first RF routing panel; the first RF component may be connected to the first member. In the second relative rotational configuration, the first RF routing panel may be in a configuration in which the first waveguide is not operable to route RF power from or to the first RF component.

In some such implementations, the apparatus may include a second RF routing panel having additional RF components mounted thereon. A second RF component of the additional RF components may be connected with the second member and, when the first member and the second member are in the first relative rotational configuration, the first waveguide may be configured to route RF power between the first RF component and the second RF component and the first RF routing panel and the second RF routing panel may be substantially parallel to one another. When the first member and the second member are in the second relative rotational configuration, the first RF routing panel and the second RF routing panel may be at a substantial angle to one another and the first waveguide may not be configured to route RF power between the first RF component and the second RF component.

In some implementations, an apparatus is provided that may include a rotary microwave coupling, the rotary microwave coupling including a stator having (a) a first waveguide port and (b) a rotor having a waveguide channel. A distal end of the waveguide channel may form a second waveguide port. The first waveguide port, the waveguide channel, and the second waveguide port may generally be disposed in a common plane. The apparatus may also include a first waveguide coupled with the first waveguide port and a second waveguide coupled with the second waveguide port. A rotation of the rotor may result in rotation of the second waveguide with respect to the first waveguide about an axis perpendicular to the common plane.

In some such implementations, the rotation of the rotor may switch the apparatus between a first configuration and a second configuration. In the first configuration, a proximal end of the waveguide channel may be aligned with the first waveguide port and, in the second configuration, the proximal end of the waveguide channel may be disposed at a substantial angular offset about the axis from the first waveguide port.

These and other implementations are described in more detail below.

BRIEF DESCRIPTION OF THE DRAWINGS

The included drawings are for illustrative purposes and serve only to provide examples of possible structures for the concepts disclosed herein. These drawings in no way limit any changes in form and detail that may be made by one skilled in the art without departing from the spirit and scope of the disclosed embodiments.

FIGS. 25, 26, 27, and 28 depict the example waveguide hinge of FIG. 21 in various rotational states.

FIG. 29 depicts the example waveguide hinge of FIG. 21.

Figure 1:
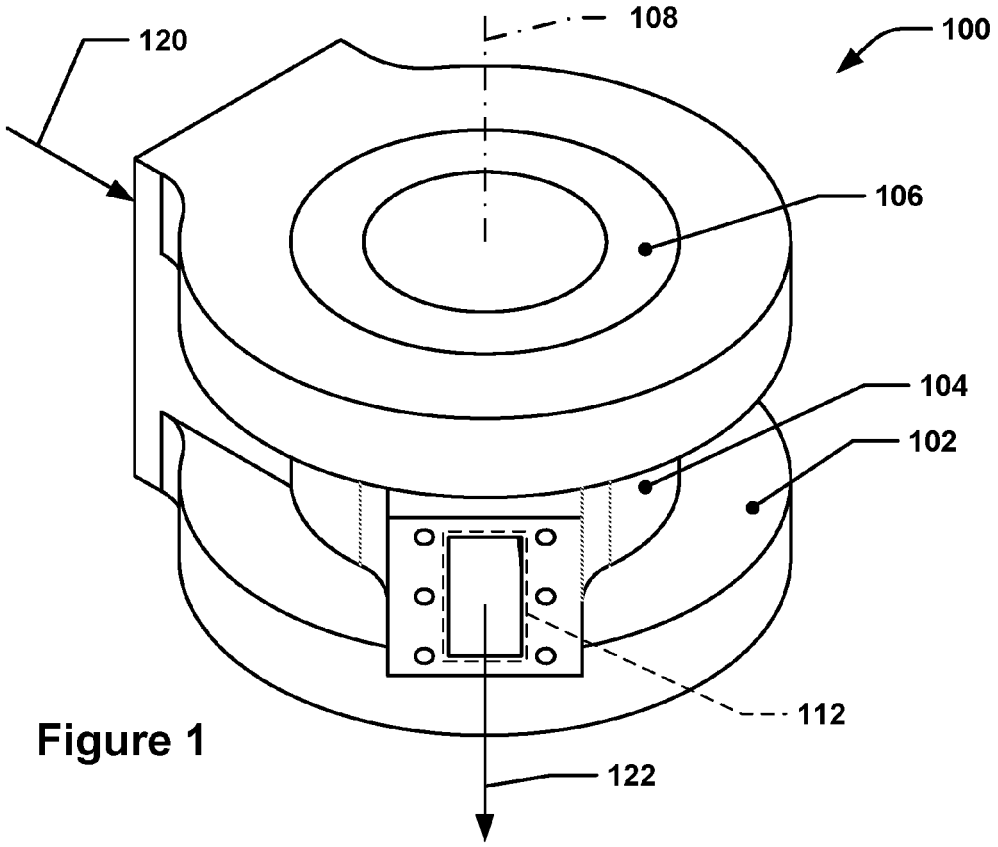
FIG. 1 depicts an isometric view of an example waveguide hinge.

Throughout the drawings, the same reference numerals and characters, or reference numbers sharing the same last two digits, unless otherwise stated or suggested by the text or Figures, are used to denote like features, elements, components, or portions of the illustrated embodiments. Moreover, while the concepts herein will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of concepts discussed herein will now be described with reference to the accompanying drawings. These concepts may, however, be embodied in many different forms, and should not be construed as limited to the embodiments set forth herein. Rather, these embodiments are provided so that this disclosure will be thorough and complete, and will fully convey the scope of the concepts disclosed herein to those skilled in the art.

It will be understood that when an element is referred to as being "connected" or "coupled" to another element, it can be directly connected or coupled to the other element, or intervening elements may be present; the term "coupled" may also refer to two elements that are coupled via a contiguous structure, e.g., a single, molded part may have a "tab" that is coupled with a "body." Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. As used herein, the term "and/or" includes any and all combinations of one or more of the associated listed items. The symbol "/" is also used as a shorthand notation for "and/or".

The terms "spacecraft", "satellite" may be used interchangeably herein, and generally refer to any satellite or spacecraft system designed to be placed in orbit around the Earth or other celestial body.

The term "main body" as used herein, unless otherwise expressly indicated, refers to the nominal major structure of the spacecraft. The main body typically contains the internal payload and bus equipment of the spacecraft and provides structural mounting locations for various external elements, such as solar panels, antenna reflectors, thermal management elements, antenna feeds, launch vehicle mating interfaces, equipment modules, etc.

The term "boom," as used herein, refers to a long, generally thin, beam-like structure that is used to support a piece of equipment, e.g., an antenna reflector, at some distance from another body, e.g., the main body.

Figure 2:
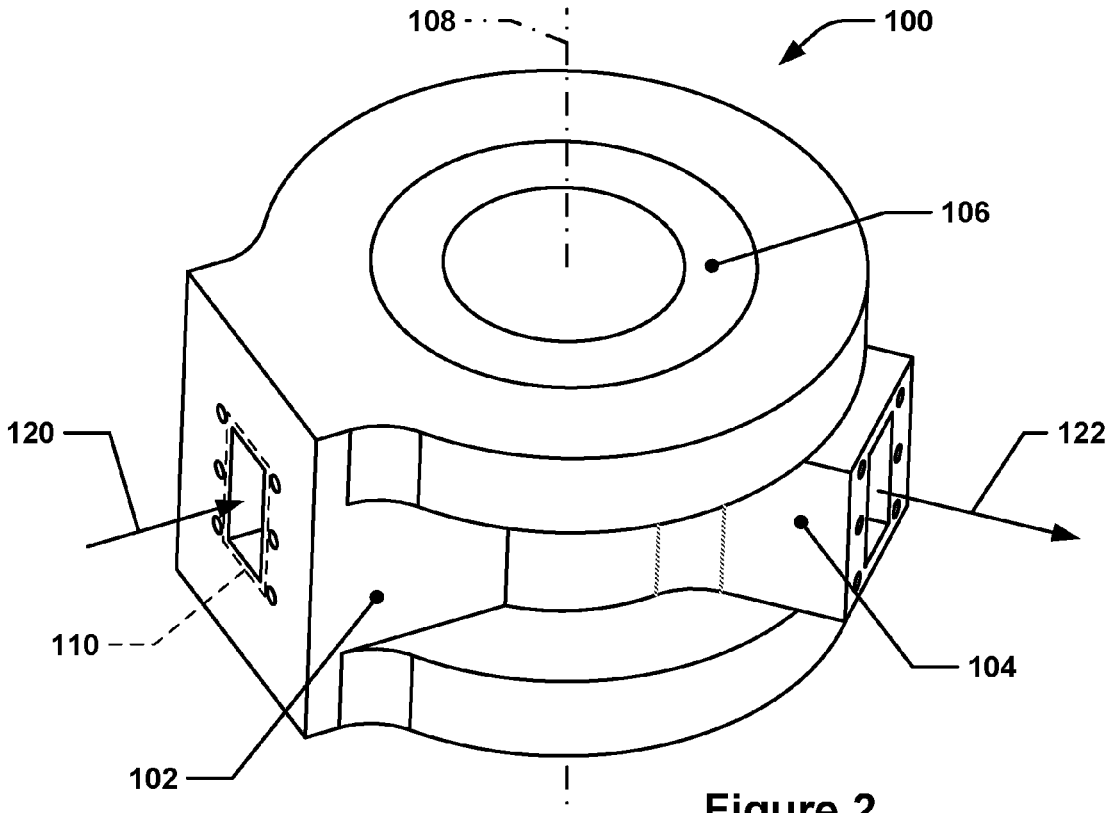
FIG. 2 depicts another view of the example waveguide hinge of FIG. 1.
Figure 3:
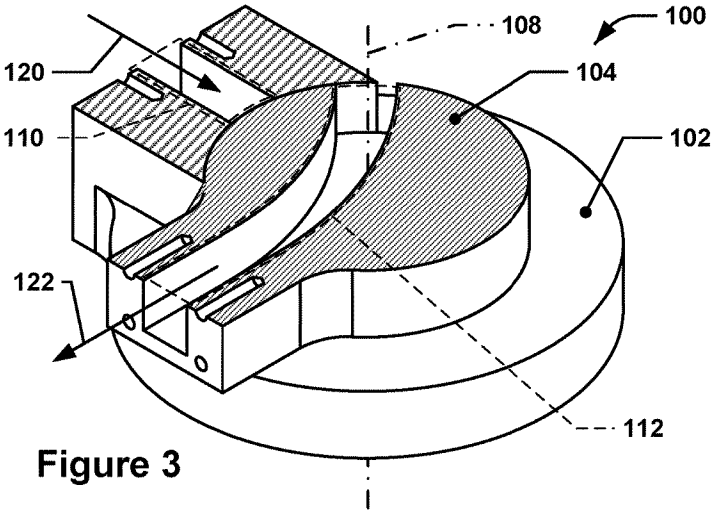

FIG. 1 depicts an isometric view of an example waveguide hinge; FIG. 2 depicts another view of the example waveguide hinge of FIG. 1. In FIGS. 1 and 2, a waveguide hinge 100 is depicted. The waveguide hinge 100 includes a first member 102 and a second member 104. The first member 102 and the second member 104 may be connected with one another in a rotatable manner, e.g., via a bearing 106, such that the first member 102 and the second member 104 may be rotated relative to one another about a rotational axis 108 in order to be transitioned between a number of relative rotational configurations. In FIGS. 1 and 3, the first member 102 and the second member 104 are in a first relative rotational configuration. The first member 102 may have a first RF waveguide portion 110 and the second member 104 may have a second RF waveguide portion 112. Each RF waveguide portion may extend into the waveguide hinge 100. The surfaces of the first member 102 and the second member 104 from which the first RF waveguide portion 110 and the second RF waveguide portion 112 enter and/or exit the waveguide hinge 100 may, for example, have threaded holes arranged in a pattern or other features that allow the first member 102 and the second member 104 to be connected with various RF components, such as rigid waveguides. In some implementations, the first member and/or the second member may be lengthened or otherwise modified so as to provide such an additional component. For example, in some implementations, instead of attaching a straight, 12" long rigid waveguide to the first member 102 to interface with the first RF waveguide portion 110, the first member 102 may simply be constructed so as to have a length longer than 12", thereby eliminating a mechanical interface. It is to be understood that such variants may be practiced with any of the example waveguide hinges discussed herein.

In the example waveguide hinge 100, the first RF waveguide portion 110 enters the first member 102 along a first direction 120 that is substantially parallel to a first axis that is perpendicular to the rotational axis 108. Similarly, the second RF waveguide portion 112 exits the second member 104 along a second direction 122 that is substantially parallel to a second axis that is also perpendicular to the rotational axis 108.

It is to be understood that the terms "enters" and "exits," with respect to the directions along which RF waveguide portions enter or exit either the first member or the second member, are relative terms provided with reference to a nominal direction of RF wave travel and are somewhat arbitrary. It is to be understood that such terms may be used reversibly, i.e., a waveguide hinge in which the first RF waveguide portion enters the first member and the second RF waveguide portion exits the second member may be described in the inverse if the nominal direction of RF travel is reversed, i.e., the first RF waveguide portion exits the first member and the second RF waveguide portion enters the second member. In some cases, a waveguide may support RF travel in both directions simultaneously, in which case each waveguide portion may be viewed as both "exiting" and "entering" its respective member simultaneously. For ease of discussion, this disclosure uses "exiting" and "entering" as if there were a single nominal direction of RF travel, but it is to be understood that such terms do not limit the direction of RF travel, and that configurations with "opposite" exiting/entering characteristics or configurations with bi-directional RF travel still fall within the scope of this disclosure and the claims.

FIGS. 3 through 6 depict isometric section views of the example waveguide hinge of FIG. 1 in different rotational states. As can be seen in FIG. 3, the first RF waveguide portion 110 is blocked by the second member 104, i.e., there is no substantially continuous waveguide through the waveguide hinge in FIG. 3. The first member 102 and the second member 104 in FIG. 3 are shown in a second relative rotational configuration.

Figure 4:
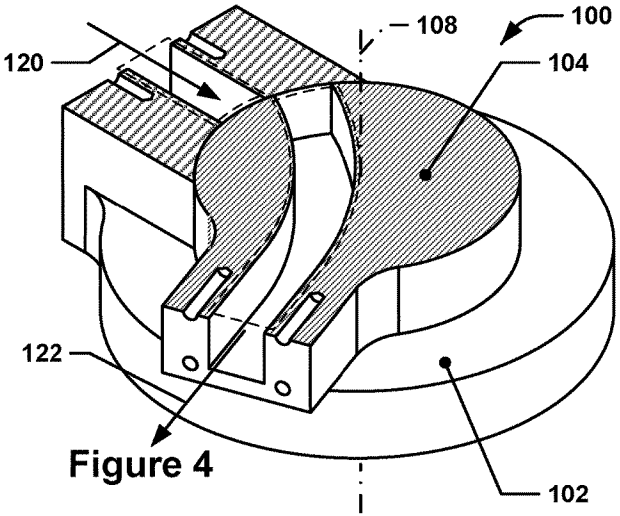
FIGS. 3, 4, 5, and 6 depict isometric section views of the example waveguide hinge of FIG. 1 in different rotational states.
Figure 6:
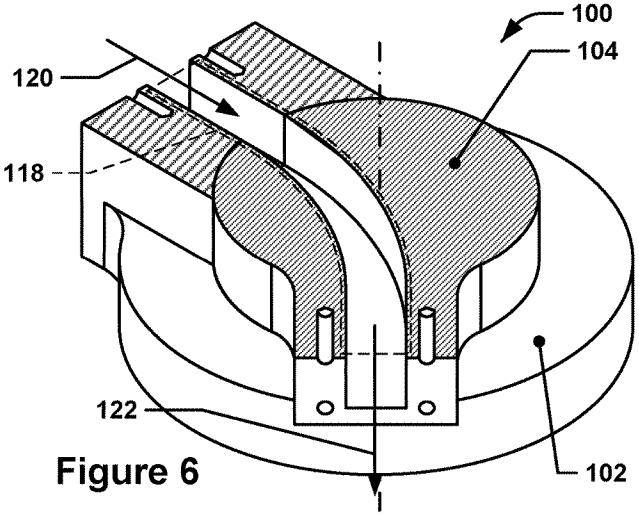
Figure 5:
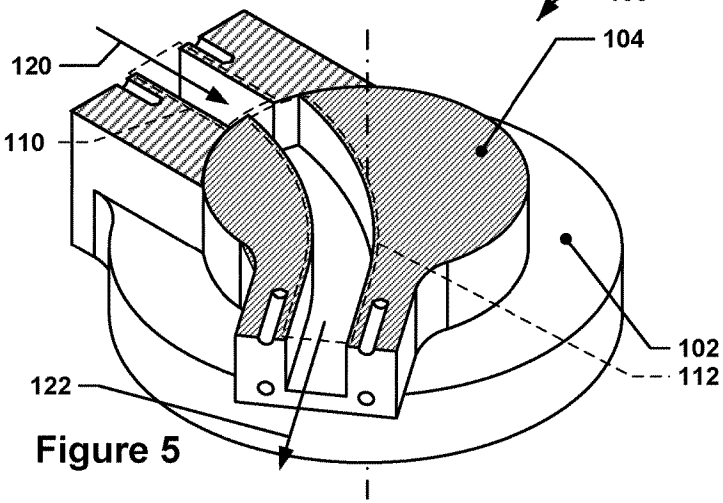

FIGS. 4 and 5 depict the waveguide hinge 100 in various transitional relative angular configurations that occur from the transition of the waveguide hinge 100 from the second relative rotational configuration to the first relative rotational configuration, which is shown in FIG. 6. As can be seen in FIG. 6, when the waveguide hinge 100 is in the first relative rotational position, the first RF waveguide portion 110 is aligned with the second RF waveguide portion 112 to form a substantially continuous first waveguide 118.

It is to be understood that while the first RF waveguide portion 110 and the second RF waveguide portion 112 shown form a first waveguide 118 following a particular path, e.g., a path that deviates ~30° from the first direction 120 as it passes through the waveguide hinge 100, the first RF waveguide portion 110 and the second RF waveguide portion 112 may be configured such that the first waveguide 118 follows other paths, e.g., a path that is a straight path through the waveguide hinge 100, a path that turns 90° through the waveguide hinge 100, etc.

Figure 7:
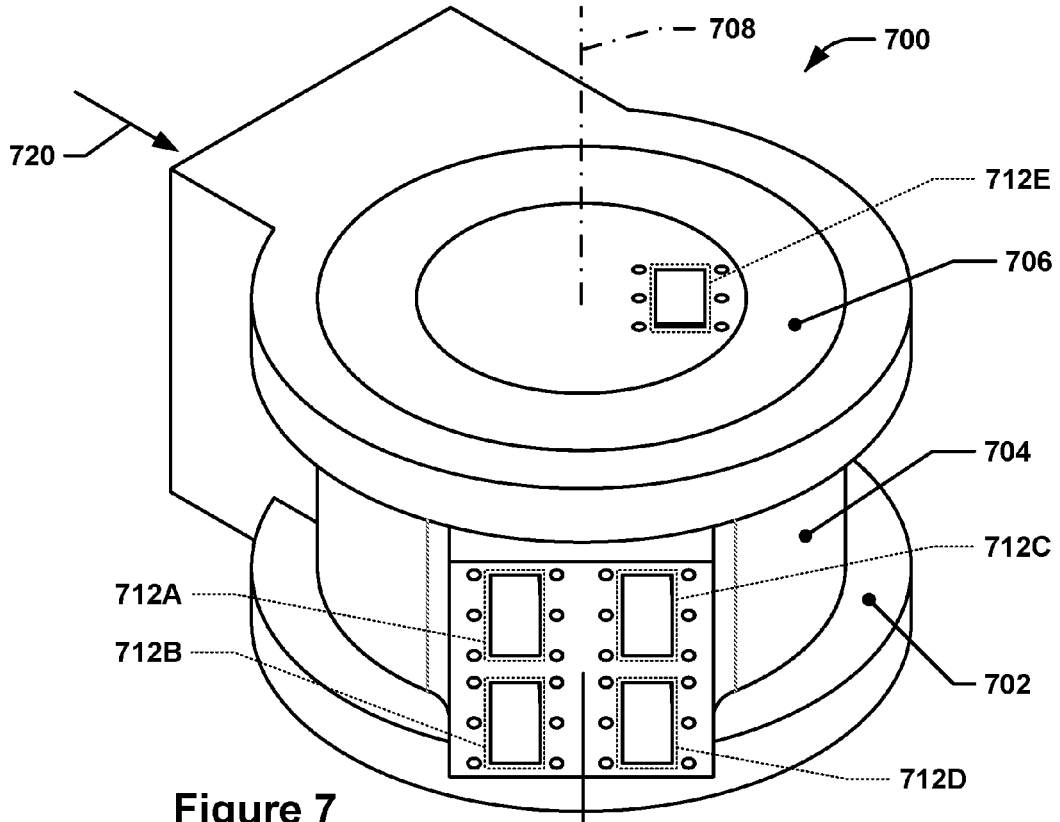
FIG. 7 depicts an isometric view of an example waveguide hinge with multiple waveguides.
Figure 8:
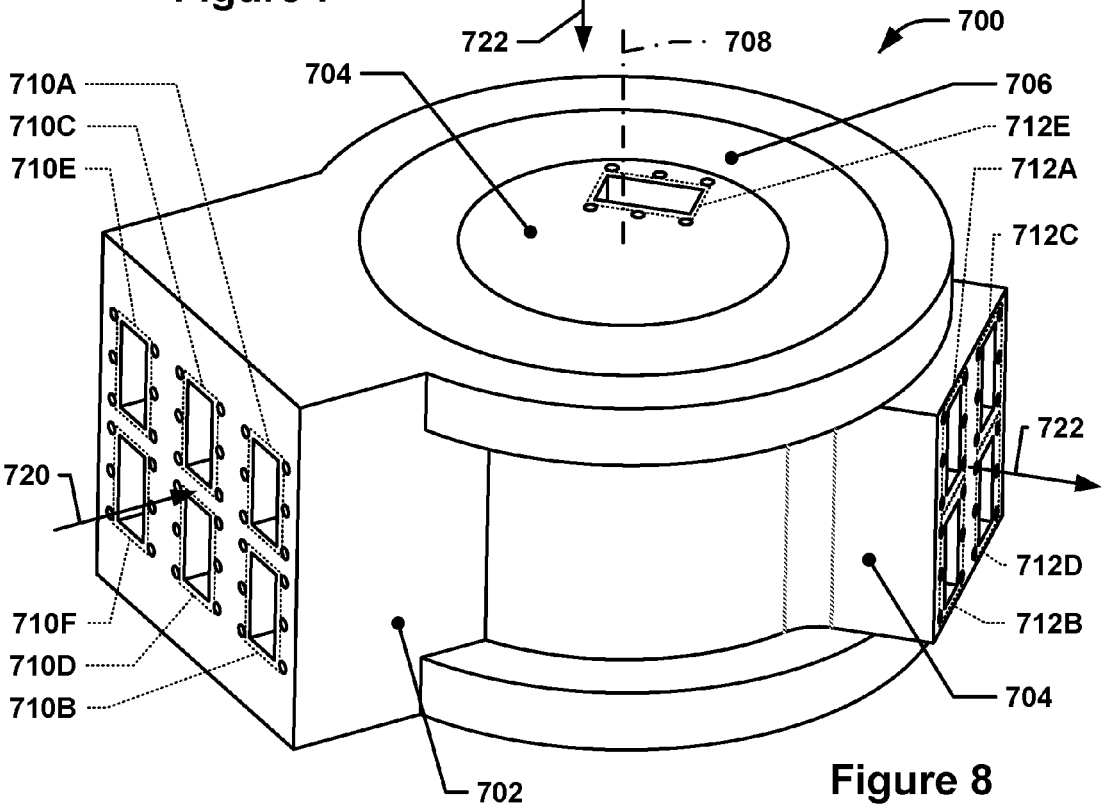
FIG. 8 depicts another view of the example waveguide hinge of FIG. 7.

It is also to be understood that waveguide hinges, as described herein, may be configured to provide multiple waveguides through the waveguide hinge. FIG. 7 depicts an isometric view of an example waveguide hinge with multiple waveguides. FIG. 8 depicts another view of the example waveguide hinge of FIG. 7.

As can be seen, FIGS. 7 and 8 depict a waveguide hinge 700 that includes six waveguides. The waveguide hinge 700 has a first member 702 and a second member 704 that are configured to rotate relative to one another, e.g., via a rotational interface such as a bearing 706, about a rotational axis 708. The first member 702 and the second member 704 may be rotated relative to one another in order to transition from a first relative rotational configuration, as shown in FIGS. 7 and 8, to a second relative rotational configuration (see FIG. 11, discussed later). It is to be understood that the waveguide hinge 700 may pass through various intermediate relative rotational configurations during such a transition (see FIGS. 12 and 13, also discussed later).

In the first relative angular configuration, each first RF waveguide portion 710A-F aligns within the waveguide hinge 700 with a corresponding second RF waveguide portion 712A-F to form a substantially continuous waveguide. In the example waveguide hinge 700, the first RF waveguide portions 710A-F enter the first member 702 of the waveguide hinge 700 along a direction parallel to a first axis 720. Four of the second RF waveguide portions, second RF waveguide portions 712A, 712B, 712C, and 712D, exit the second member along a direction that is substantially parallel to a second axis 722 that is perpendicular to the rotational axis 708. The remaining two second RF waveguide portions, second RF waveguide portions 712E and 712F (not illustrated here, but illustrated in later Figures), exit the second member 704 along a direction that is substantially parallel to the rotational axis 708.

Figure 9:
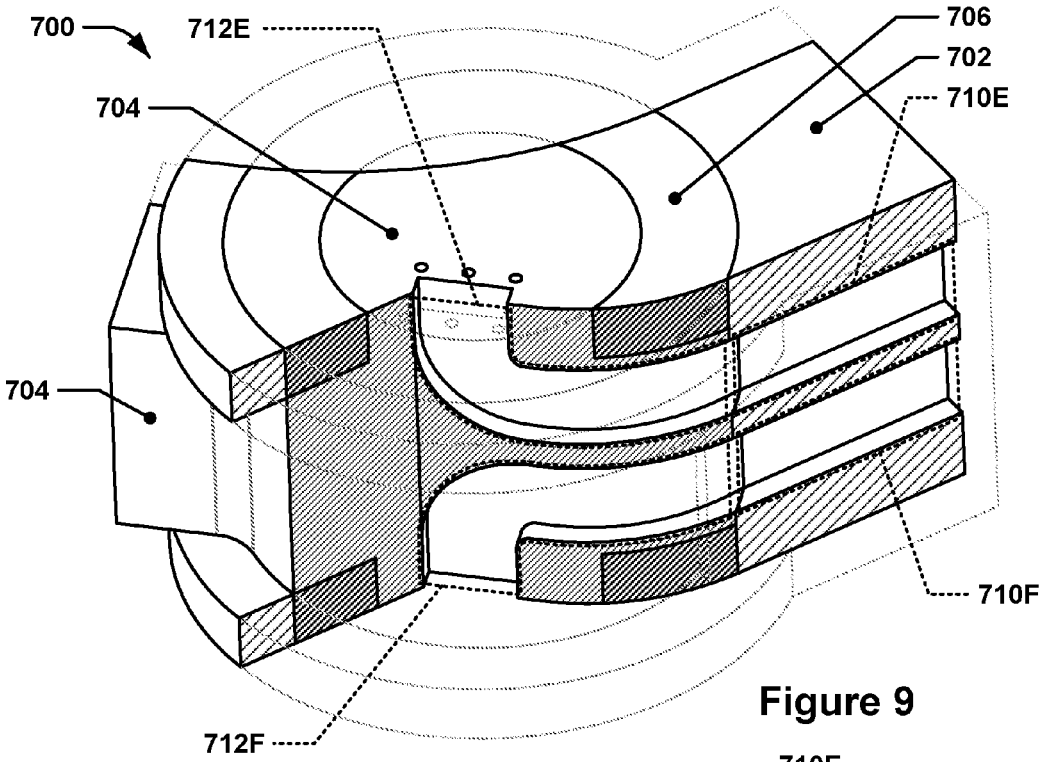
FIG. 9 depicts an off-angle cutaway view of the example waveguide hinge of FIG. 7 depicting two of the six waveguides included in the example waveguide hinge.
Figure 10:
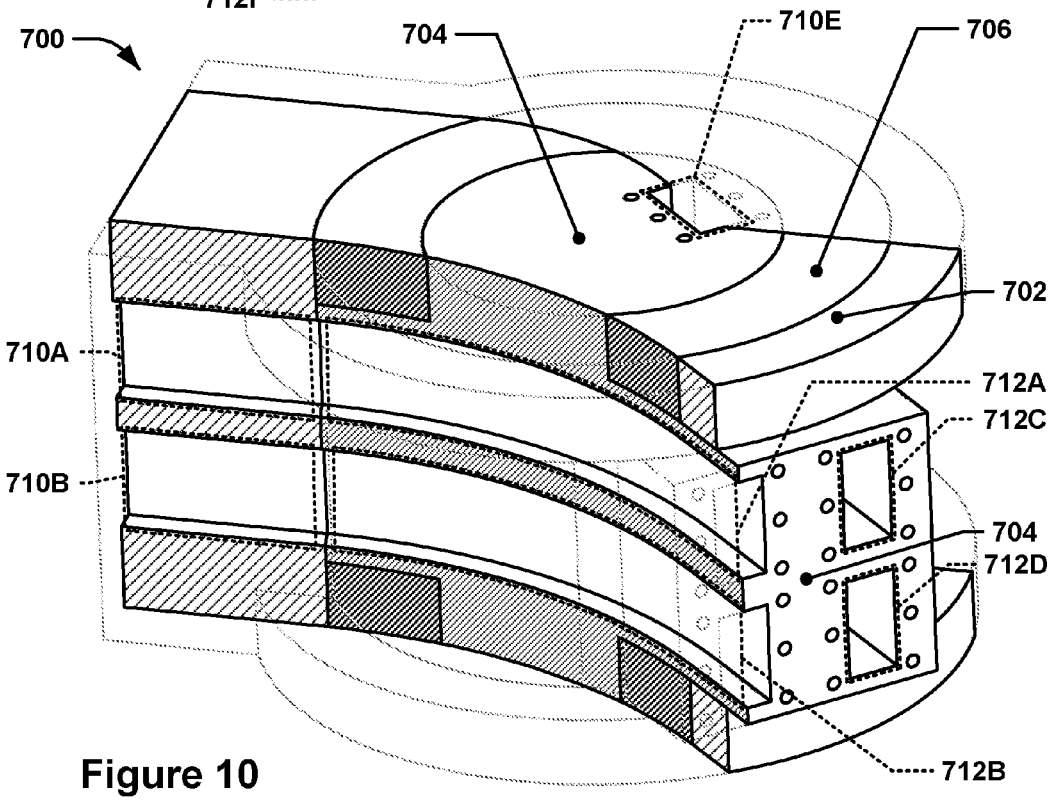
FIG. 10 depicts another off-angle cutaway view of the example waveguide hinge of FIG. 7 depicting another two of the six waveguides included in the example waveguide hinge.

FIG. 9 depicts an off-angle cutaway view of the example waveguide hinge of FIG. 7 depicting two of the six waveguides included in the example waveguide hinge. FIG. 10 depicts another off-angle cutaway view of the example waveguide hinge of FIG. 7 depicting another two of the six waveguides included in the example waveguide hinge.

As can be seen in these cutaway views, when in the first relative rotational configuration, the first RF waveguide portions 710A-F each align with a corresponding second RF waveguide portion of the second RF waveguide portions 712A-F to provide a plurality of substantially continuous waveguides; this is shown explicitly for the first RF waveguide portions 710A and 710B and the second RF waveguide portions 712A and 712B (see FIG. 10), respectively, and for the first RF waveguide portions 710E and 710F and the second RF waveguide portions 712E and 712F (see FIG. 9), respectively. Although not explicitly shown, the first RF waveguide portions 710C and 710D and the second RF waveguide portions 712C and 712D form substantially continuous waveguides in a manner similar to the first RF waveguide portions 710A and 710B and the second RF waveguide portions 712A and 712B.

Figure 11:
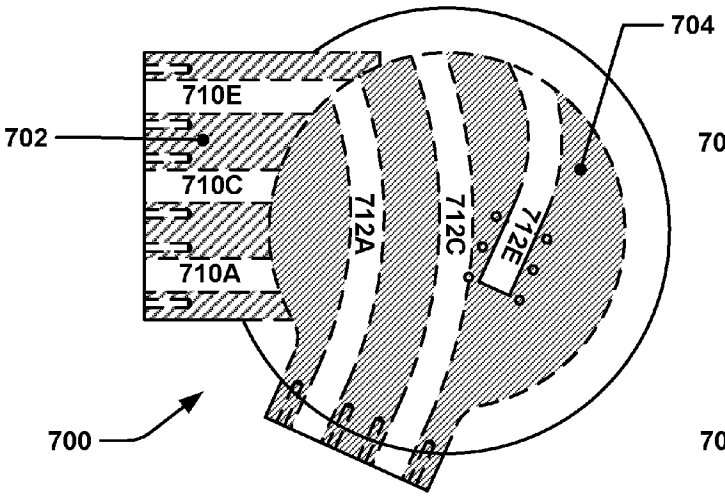
FIGS. 11, 12, 13, and 14 depict simplified section views of the example waveguide hinge of FIG. 7 during various states of rotation.
Figure 12:
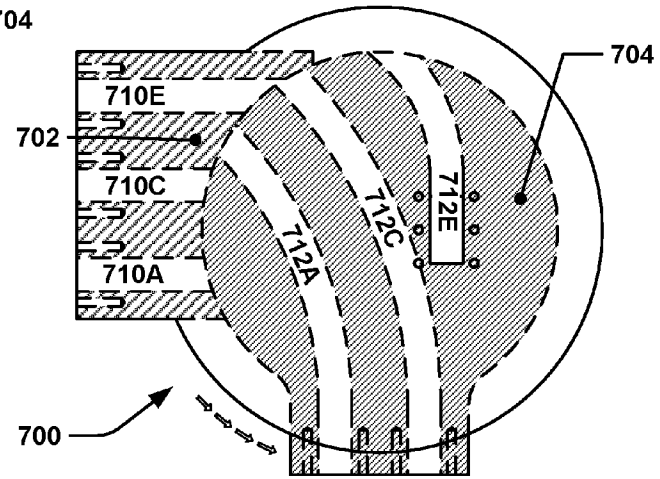
Figure 13:
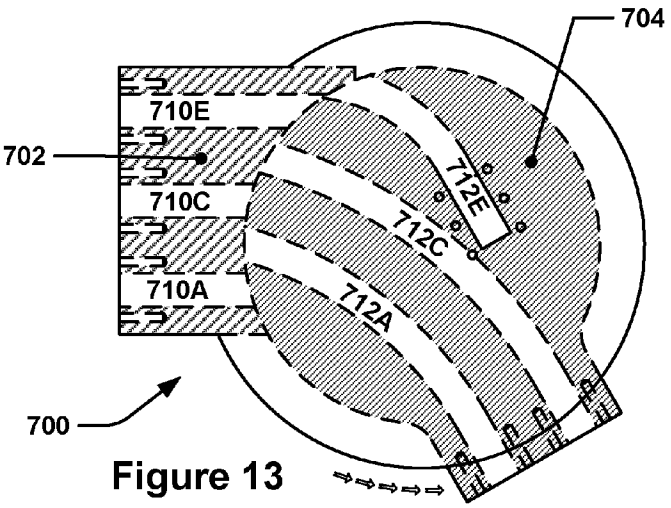
Figure 14:
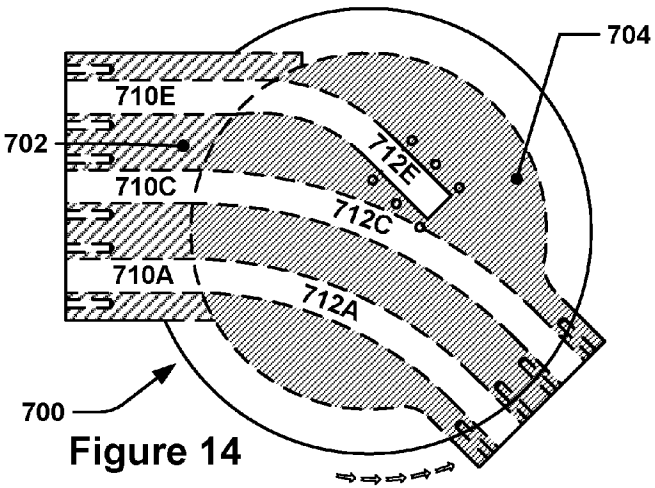

FIGS. 11 through 14 depict simplified section views of the example waveguide hinge of FIG. 7 during various states of rotation. In FIG. 11, the first member 702 and the second member 704 are in the second relative rotational configuration, and in FIG. 14, the first member 702 and the second member 704 are in the first relative rotational configuration. FIGS. 12 and 13 depict the first member 702 and the second member 704 in various transitional relative rotational configurations that may be passed through in transitioning between the first relative rotational configuration and the second relative rotational configuration.

As can be seen in the second relative rotational configuration, the first RF waveguide portion 710E and the second RF waveguide portion 712A are partially aligned with one another, although not in a manner that produces a substantially continuous waveguide. In order for a waveguide to be effective or operable, the surfaces defining the waveguide should be smooth and continuous; discontinuities such as sharp edges, changes in cross-sectional area along the path of the waveguide, and abrupt changes in waveguide path direction will compromise the performance of the waveguide. As can be seen, the alignment of the first RF waveguide portion 710E and the second RF waveguide portion 712A in the second relative rotational configuration produces at least two discontinuities in the wall profile, an abrupt change in the waveguide path direction, and a narrowing of the cross-sectional area of the waveguide at the interface where the two waveguide portions meet. Thus, it cannot be said that the first RF waveguide portion 710E and the second RF waveguide portion 712A are aligned so as to produce a substantially continuous waveguide in the second relative rotational configuration.

It is to be understood that the term "substantially continuous" is used with respect to the waveguide that is formed by the alignment of the first RF waveguide portion and the second RF waveguide portion in acknowledgement of the fact that the waveguide may have some negligible discontinuities that do not noticeably affect RF transmission performance within the waveguide. For example, there will likely be some small clearance gap, e.g., a few thousandths or hundredths of an inch, between the first member 702 and the second member 704 in order to allow for the first member 702 and the second member 704 to rotate relative to one another without actually touching—this may help prevent friction loading, binding, and abrasion, all of which can negatively impact the waveguide hinge performance. Such a gap, while a discontinuity, would not be viewed negating the substantially continuous nature of the waveguide formed in the first relative rotational configuration. In another example, the first RF waveguide portions 710A-F and the second RF waveguide portions 712A-F may incorporate RF-transparent membranes at the exposed ends of each portion, e.g., at the ends of the waveguide portions that terminate at exterior surfaces of the first member 702 and the second member 704, and/or at the ends of the waveguide portions that are aligned within the waveguide hinge in the first relative rotational configuration. These membranes may, for example, be made of Kapton or other material that is transmissive to RF energy, but that may act as a physical barrier to keep debris from entering the RF waveguide portions. Thus, from a physical intrusion perspective, such RF-transparent membranes may be viewed as discontinuities in the waveguide formed by the first RF waveguide portions and the second RF waveguide portions because they prevent the movement of physical objects through the waveguide. However, such barriers have a negligible effect on the transmission of RF energy through the waveguide. Accordingly, a waveguide with one or more RF-permeable membranes located along its length may still be viewed as being "substantially continuous."

Figure 15:
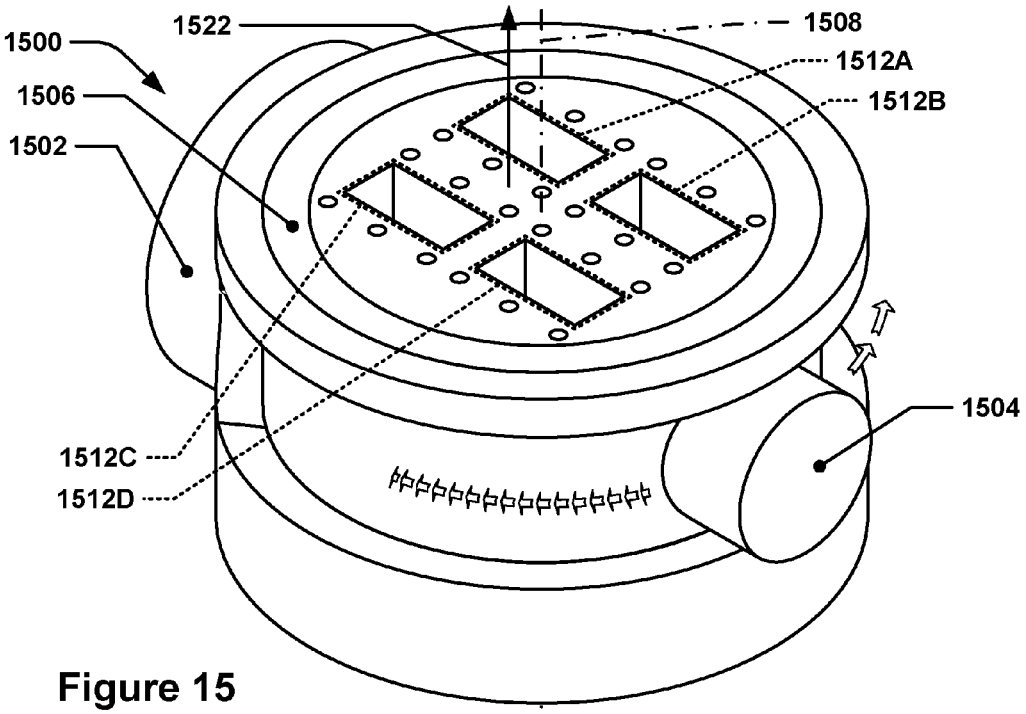
FIG. 15 depicts another example waveguide hinge.
Figure 16:
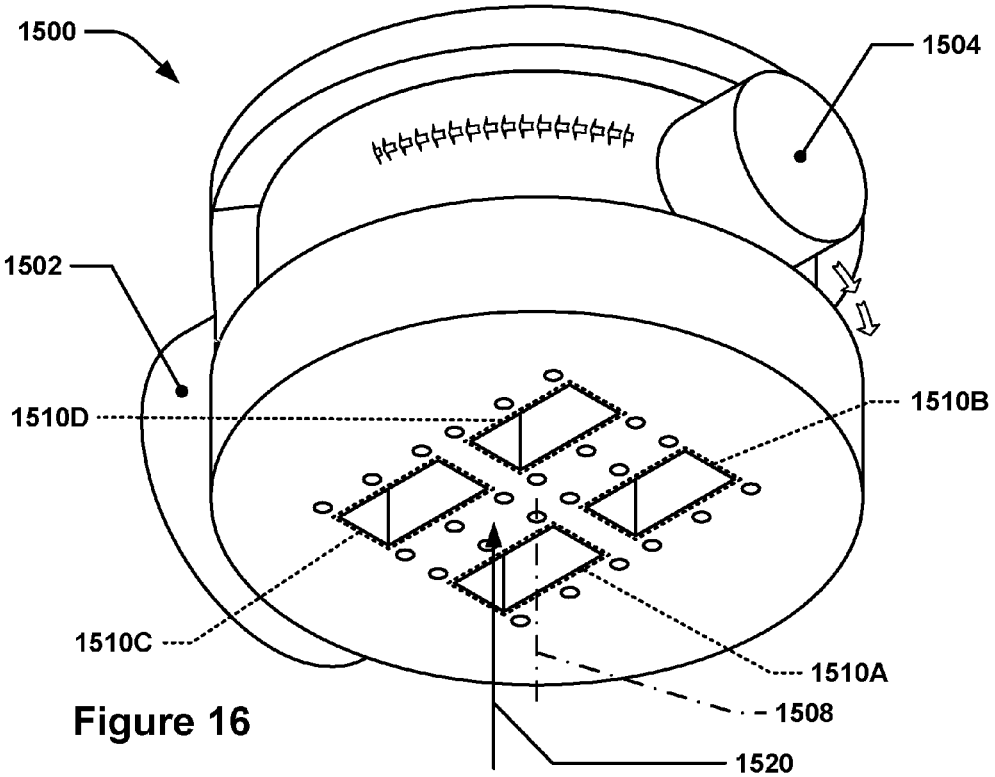
FIG. 16 depicts another view of the example waveguide hinge of FIG. 15.

FIG. 15 depicts another example waveguide hinge. FIG. 16 depicts another view of the example waveguide hinge of FIG. 15.

In FIG. 15, a waveguide hinge 1500 is depicted with a first member 1502 and a second member 1504. The first member 1502 and the second member 1504 may be rotatably coupled, e.g., via a bearing 1506, so as to be rotatable relative to one another about a rotational axis 1508. In FIG. 15, the first member 1502 and the second member 1504 are shown in a first relative rotational configuration; the first member 1502 and the second member 1504 may, as with the other example waveguide hinges discussed earlier, be transitioned between the first relative rotational configuration and a second relative rotational configuration during use.

In this example waveguide hinge 1500, the first member 1502 may have a plurality of first RF waveguide portions 1510A-D that enter the first member 1502 along a direction 1520 that is substantially parallel to the rotational axis 1508; correspondingly, the second member 1504 may have a plurality of second RF waveguide portions 1512A-D that exit the second member 1504 along a direction 1522 that is also substantially parallel to the rotational axis 1508.

It is to be understood that the phrase "substantially parallel," as used herein with respect to the entering/exiting directions of the various waveguide portions discussed herein, refers to a generally parallel relationship, but may include deviations between the indicated direction and axis of up to ±10°.

The waveguide hinge 1500 is different from the waveguide hinges discussed previously in that the waveguides that may be formed by the alignment of the first RF waveguide portions 1510A-D and the second RF waveguide portions 1512A-D generally travel through the waveguide hinge 1500 along directions parallel to the rotational axis 1508, as opposed to directions perpendicular to the rotational axis 1508. In this example, the first RF waveguide portions 1510A-D and the second RF waveguide portions 1512A-D have rectangular cross-sections and follow paths that are substantially parallel to the rotational axis.

In such a waveguide hinge, additional components, such as rigid 90° elbow or bend waveguides, may be attached to the first member 1502 and/or the second member 1504 in order to, for example, route the RF signals passing through the waveguide hinge 1500 such that, before, after, or both before and after the waveguide hinge 1500, the RF signals are directed along waveguide paths that may, for example, be generally perpendicular to, or at an oblique angle to, the rotational axis 1508.

Figure 17:
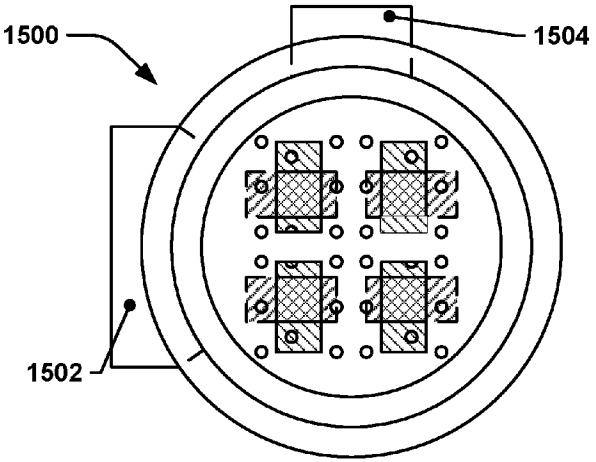
FIGS. 17, 18, 19 and 20 depict plan views of the example waveguide hinge of FIG. 15 in various rotational states.
Figure 18:
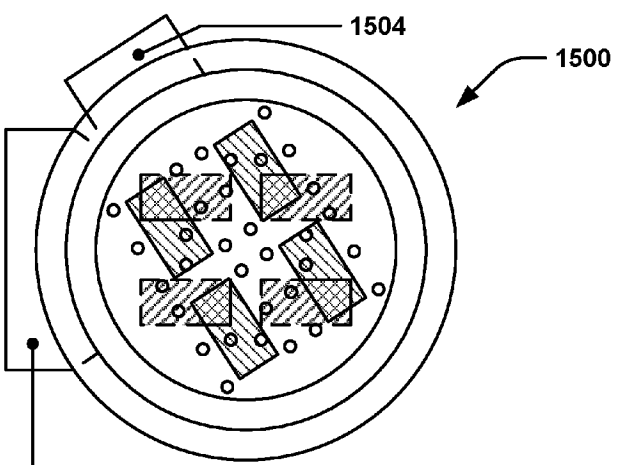
Figure 19:
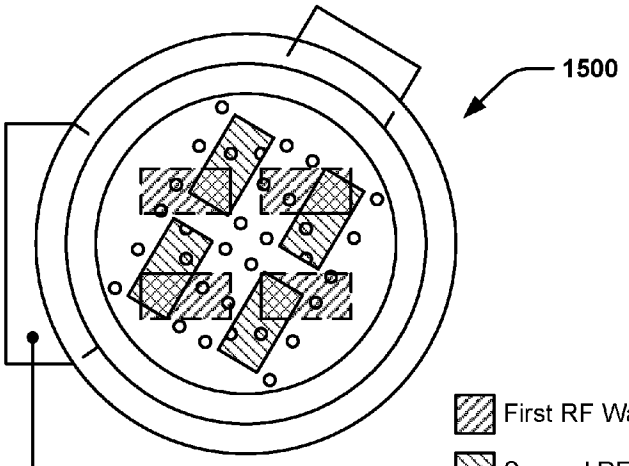
Figure 20:
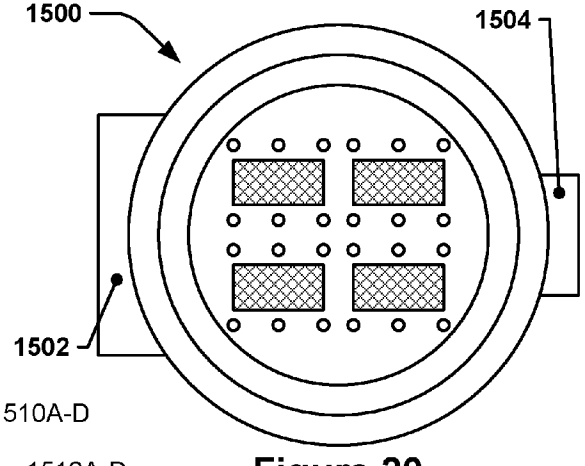

FIGS. 17 through 20 depict plan views of the example waveguide hinge of FIG. 15 in various rotational states. In FIG. 17, the second relative rotational state is shown, and in FIG. 20, the first relative rotational state is shown. FIGS. 18 and 19 depict intermediate relative rotational configurations through which the first member 1502 and the second member 1504 may pass when transitioning between the first relative rotational configuration and the second relative rotational configuration.

In FIGS. 17 through 20, the cross-sectional areas of the first RF waveguide portions 1510A-D are indicated by diagonal hatched areas with lines travelling from the lower left to the upper right; the cross-sectional areas of the second RF waveguide portions 1512A-D are indicated by diagonal hatched areas with lines travelling from the upper left to the lower right. Areas where the cross-sectional areas of the first RF waveguide portions 1510A-D and the second RF waveguide portions 1512A-D overlap are indicated by a diamond-hatching pattern.

As is readily apparent, in this example waveguide hinge, there will always be some degree of alignment of the first RF waveguide portions 1510A-D and the second RF waveguide portions 1512A-D regardless of the relative rotational positioning of the first member 1502 and the second member 1504. There is, however, only one relative rotational configuration in this example waveguide hinge 1500—the first relative rotational configuration—where the first RF waveguide portions 1510A-D and the second RF waveguide portions 1512A-D are completely aligned and form substantially continuous waveguides through the waveguide hinge. In every other relative rotational configuration that the example waveguide hinge 1500 may experience, whatever waveguide is formed by the partial overlap of the first RF waveguide portions 1510A-D and the second RF waveguide portions 1512A-D has misaligned cross-sections, step discontinuities in the waveguide walls at the interface between the first RF waveguide portions 1510A-D and the second RF waveguide portions 1512A-D. In these other relative rotational configurations, the waveguides formed by the first RF waveguide portions 1510A-D and the second RF waveguide portions 1512A-D are not substantially continuous due to these discontinuities and misaligned cross-sections.

It is to be understood that the waveguide hinges discussed herein are distinct from rotational waveguide joints used, for example, in rotating radar antenna systems. Such rotational waveguide joints are designed with a waveguide that maintains a constant cross-section regardless of the relative angular positioning between the two components—in other words, the waveguide has an axially symmetric cross-section that is centered on the axis of rotation of the rotational waveguide joint. As a result, there are no discontinuities or variations in the waveguide cross-sectional profile that result from rotation of one of the components with respect to the other. Such rotational waveguide joints are particularly useful in applications where RF energy may need to pass through a waveguide in any angular configuration of the two components. In contrast, the waveguide hinges discussed herein only provide a substantially continuous waveguide in one nominal angular orientation (subject to any permissible tolerance allowance). Moreover, the waveguide hinges discussed herein may incorporate more than one or, in many cases, more than two, discrete waveguides within a single waveguide hinge, whereas a rotational waveguide joint is generally limited to only one or two discrete waveguides since such waveguides must be centered on the axis of rotation of the waveguide joint. Finally, in the waveguide hinges discussed herein, it is not necessary for the waveguides within the waveguide hinges to be centered on the rotational axis of the hinge, as is the case with a rotational waveguide joint as described above.

The characteristics of the waveguide hinges disclosed herein make them well-suited for applications in waveguides are incorporated into structures that may be reconfigurable between an in-use configuration and a stored or dormant configuration. For example, waveguide hinges such as those discussed and described herein may be used in a spacecraft or satellite in various deployable systems, such as on deployable booms that support various pieces of RF equipment, or in systems that may be reconfigurable between a maintenance or assembly configuration and an in-use configuration.

For example, a modern telecommunications satellite may incorporate a large number of RF systems involving a large number of waveguide elements and other RF components, such as RF switches. An RF switch (see, for example, U.S. Pat. No. 4,242,652, as well as U.S. Pat. Pub. No. 2014/0184353, which is owned by the assignee of the present application and is hereby incorporated by reference in its entirety) is a device having a housing and an internal turntable; the housing may have three or more interfaces for rigid or flexible waveguides to connect to, and the internal turntable may have one or more waveguide segments that may be rotated so as to provide an internal connection between one or more pairs of such interfaces. In contrast to the waveguide hinges discussed herein, the rotatable component of an RF switch is fully contained within the housing, and does not act as a "hinge" since it is not intended to couple to, or connect with, any structure outside of the housing of the switch. Moreover, rotary waveguide switches are intended to provide switching functionality between a plurality of different waveguide paths, whereas, in most implementations, the waveguide hinges of the present disclosure only have one relative rotational configuration in which the substantially continuous waveguides exist.

RF switches and RF waveguides may be assembled into large, switchable networks that allow for RF signals from different RF sources, e.g., transmitters, to be routed through different waveguide elements and, if desired, to different destinations, e.g., to different RF feeds. In some cases, there may be hundreds of such RF switches and waveguides within a given RF network in a spacecraft. Such RF components may be mounted, for example, to RF routing panels or other bulkheads within a spacecraft's main body, and there may be multiple layers of such bulkheads or panels within the spacecraft. The waveguide hinges disclosed herein may be used to form rotatable interfaces between the RF components on such an RF routing panel and some other component, e.g., another RF routing panel. Such an implementation may allow the RF routing panel to, for example, be rotated from a position in which some of the RF components may receive or send RF signals through the waveguide hinge to a position in which those RF components may no longer effectively do so—however, in this second position, the RF routing panel may be positioned so as to allow for other activities, e.g., such as to allow for access to components normally located behind the RF routing panel.

Figure 21:
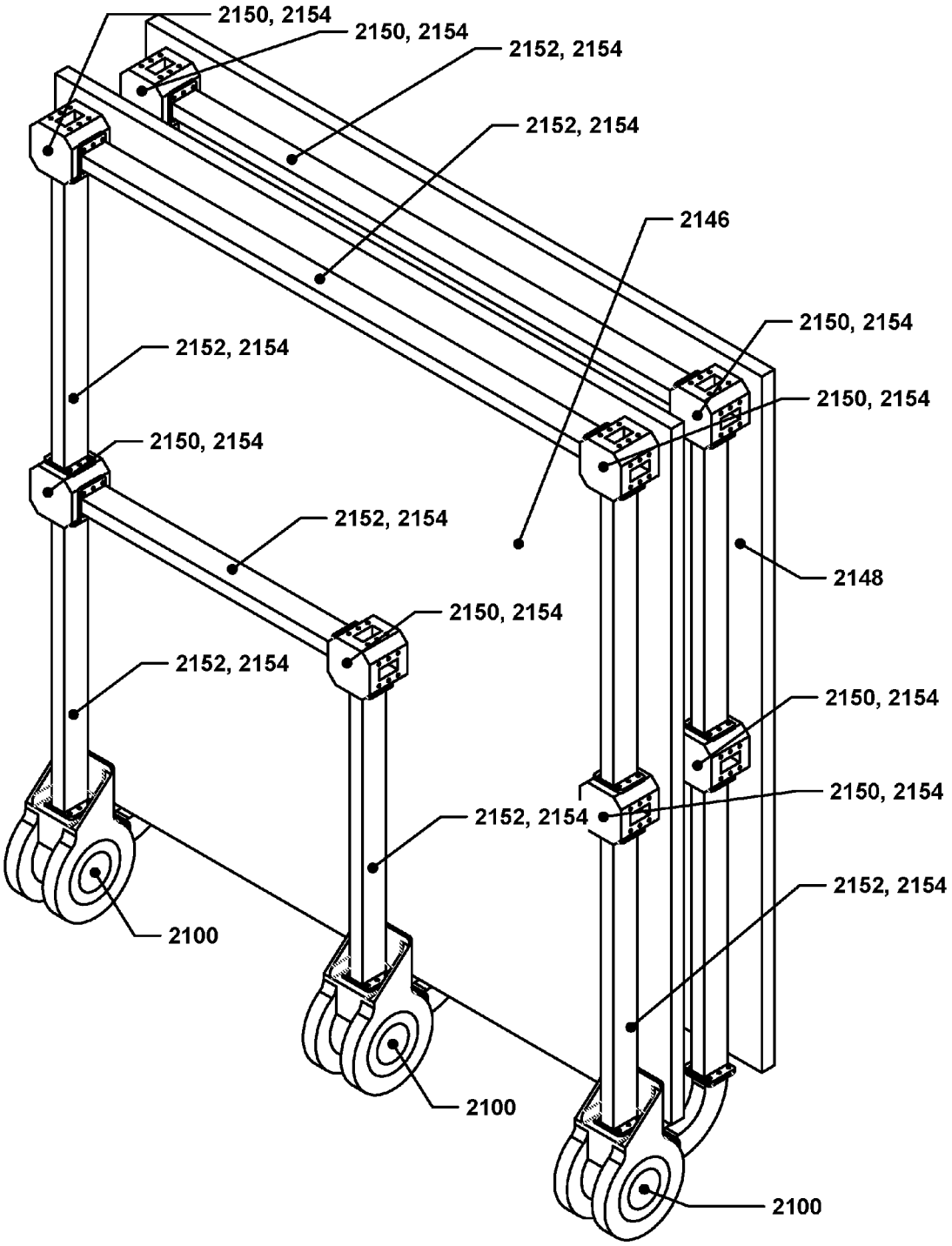
FIG. 21 depicts an isometric view of two example RF routing panels joined by example waveguide hinges.

FIG. 21 depicts an isometric view of two example RF routing panels joined by example waveguide hinges. As can be seen in FIG. 21, a first RF routing panel 2146 has a plurality of RF components 2154 mounted to it, including RF switches 2150 and rigid waveguides 2152. A second RF routing panel 2148 is located behind the first RF routing panel 2146, and has a similar RF component layout, although in actual practice, the RF component layouts on such panels may be different from one another. It is also to be understood that the RF component layout shown in FIG. 21 is not representative of an actual RF component layout, and is merely provided for illustrative purposes. For example, many of the RF switches 2150 have ports with no waveguides attached, and the networks of the RF components 2154 shown are incomplete, e.g., there is no RF source or any terminal destination for the radio waves transmitted within the network.

Figure 22:
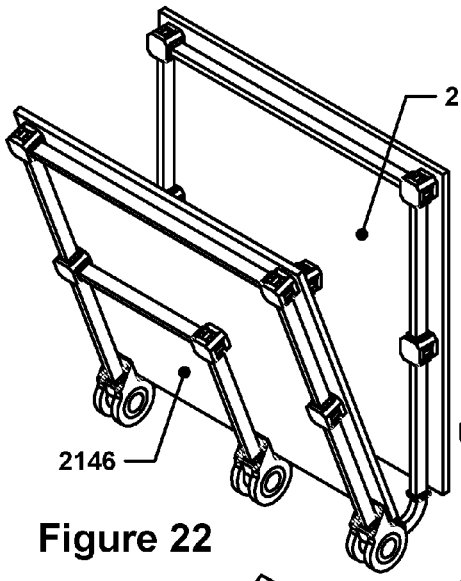
FIGS. 22, 23, and 24 depict the example RF routing panels of FIG. 21 in various states of relative rotation.
Figure 23:
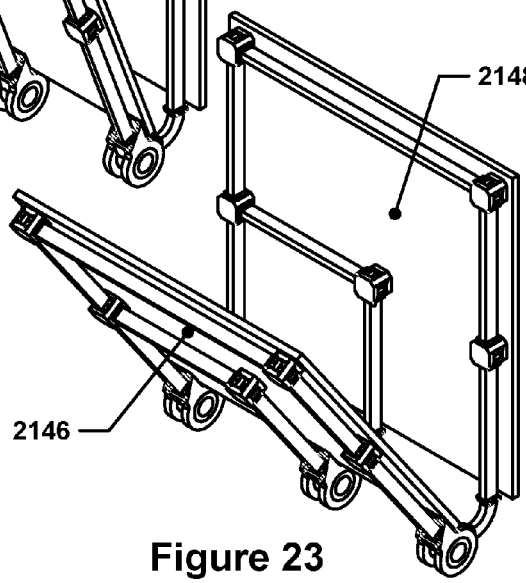
Figure 24:
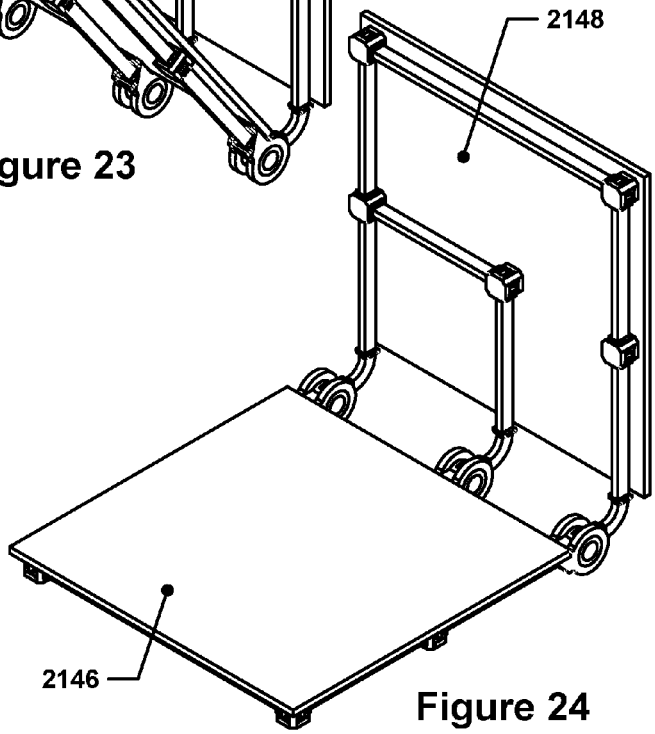

As shown, a set of three waveguide hinges 2100 are used to join RF components 2154 on the first RF routing panel 2146 with RF components 2154 mounted to the second RF routing panel 2148. If maintenance or repair is needed for the RF components 2154 mounted to the second RF routing panel 2148, then the first RF routing panel 2146 may be rotated about the rotational axes of the waveguide hinges 2100, as shown in FIGS. 22 through 24, which depict the example RF routing panels of FIG. 21 in various states of relative rotation.

FIG. 29 depicts the example waveguide hinge of FIG. 21. FIGS. 25 through 28 depict the example waveguide hinge of FIG. 21 in various rotational states. FIG. 25 depicts a cross-sectional view of the waveguide hinge 2100 in the first relative rotational configuration, and FIGS. 26 through 28 depict cross-sectional views of the waveguide hinge 2100 in relative rotational configurations corresponding with the configurations shown in FIGS. 22 through 24, respectively; the last relative rotational configuration shown is the second relative rotational configuration in this example. As can be seen, when a first member 2102 and a second member 2104 of the waveguide hinge 2100 are in the first relative rotational configuration, a first RF waveguide portion 2110 in the first member 2102 is aligned with a second RF waveguide portion 2112 in the second member 2104 within the waveguide hinge 2100, thereby producing a first substantially continuous waveguide. In the other relative rotational configurations shown, the first substantially continuous waveguide is not present due to misalignment between the first RF waveguide portion 2110 and the second RF waveguide portion 2112.

Figure 30:
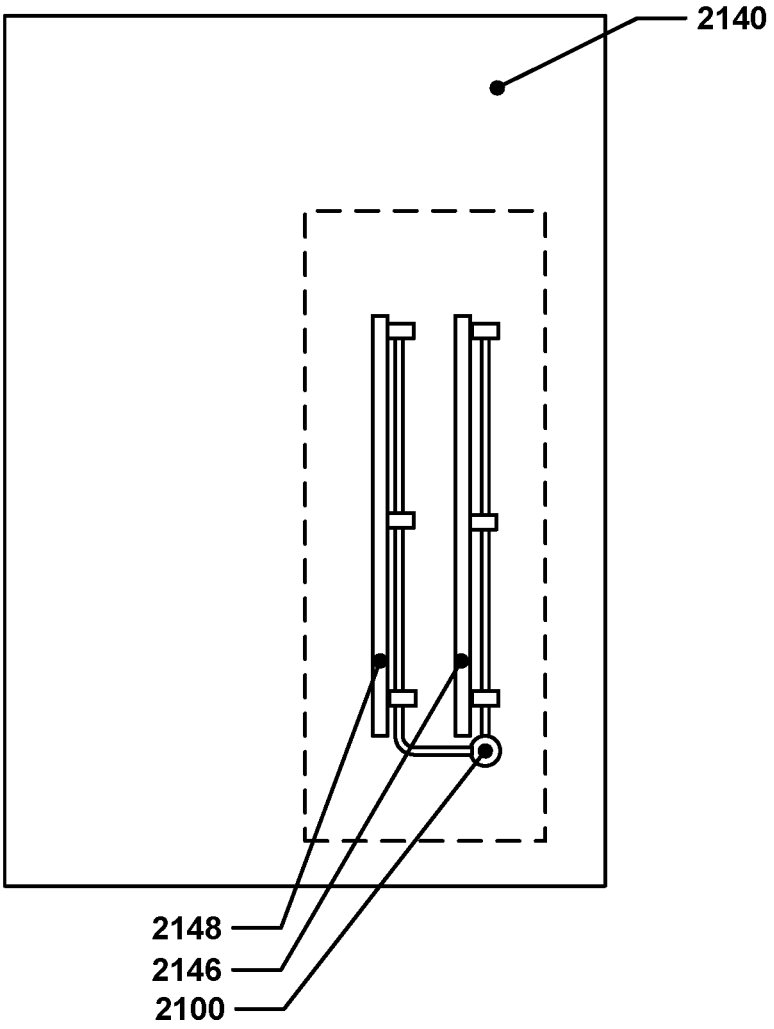
FIG. 30 depicts the example RF routing panels of FIG. 21 in an example spacecraft.

FIG. 30 depicts the example RF routing panels of FIG. 21 in an example spacecraft. As discussed, the first RF routing panel 2146 and second RF routing panel 2148 may be mounted within a spacecraft main body, such as spacecraft main body 2140 shown in FIG. 30.

In addition to implementations such as the RF routing panel application discussed above, waveguide hinges may also be used for deployable systems, such as deployable booms.

Figure 31:
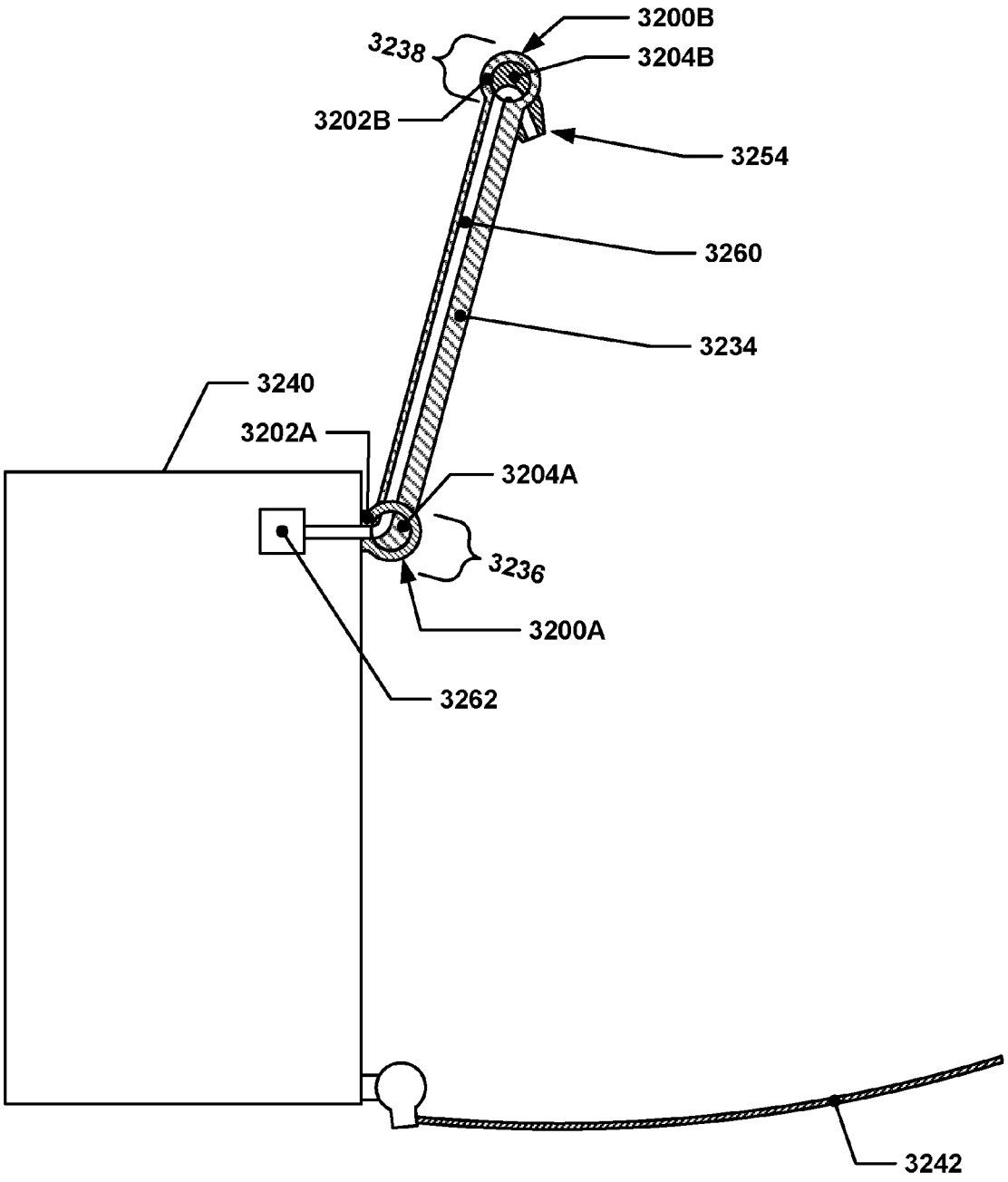
FIG. 31 depicts an example spacecraft with a deployment boom incorporating two example waveguide hinges in a deployed configuration.
Figure 32:
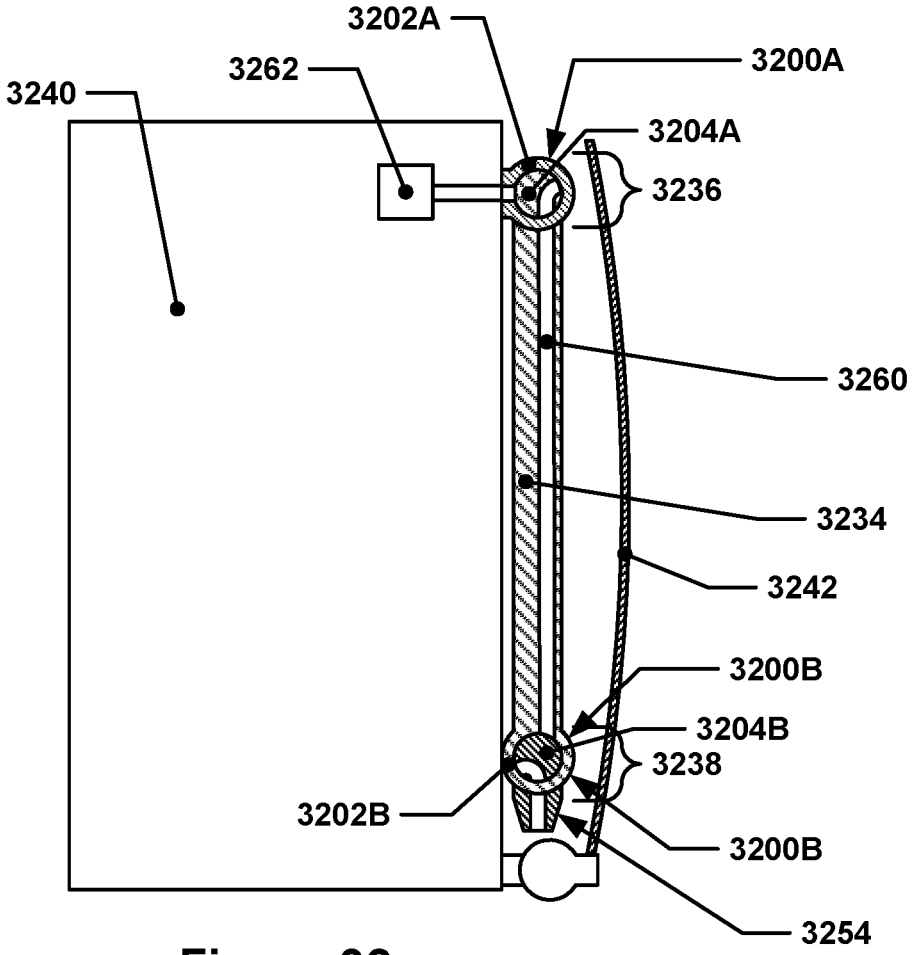
FIG. 32 depicts the example spacecraft of FIG. 31 in a stowed configuration.

FIG. 31 depicts an example spacecraft with a deployment boom incorporating two example waveguide hinges in a deployed configuration. FIG. 32 depicts the example spacecraft of FIG. 31 in a stowed configuration.

In FIGS. 32 and 31, a deployable boom 3234 may be coupled to a spacecraft main body 3240 by way of a waveguide hinge 3200A located at a proximal end 3236 of the deployable boom 3234; another waveguide hinge 3200B may connect a distal end 3238 of the deployable boom 3234 with an RF component 3254, e.g., an antenna feed or the like. The deployable boom 3234 may include a boom RF waveguide 3260 that may route RF signals from the proximal end 3236 to the distal end 3238, or vice-versa. In this example, the spacecraft may also include a rigid antenna reflector 3242.

When the spacecraft is in an operational, on-orbit configuration, the deployable boom 3234 may be extended away from the spacecraft main body 3240 and the waveguide hinges 3200A and 3200B may have first members 3202A and 3202B and second members 3204A and 3204B in respective first relative rotational configurations. A main body RF source 3262, e.g., a transmitter, may be located within the main body and may include one or more rigid or flexible waveguides that route RF energy to the waveguide hinge 3200A. In the first relative rotational configuration, the waveguide hinge 3200A may provide a substantially continuous waveguide that guides RF energy through the waveguide hinge 3200A and into the boom RF waveguide 3260, which may then direct the RF energy through the waveguide hinge 3200B and into the RF component 3254. This RF energy may then be emitted out of the RF component 3254 and directed at, for example, an antenna reflector 3242, which may then focus and redirect such RF energy at a distant target, such as an earth-based receiving system. Such a system may also operate in reverse—the main body RF source may be replaced with a receiver or other RF component, and RF energy that is reflected off of the antenna reflector 3242 may be concentrated on the RF component 3254 and then routed to the receiver or other RF component.

When the spacecraft is in a launch configuration, the deployable boom 3234 may be folded against the main body 3240, e.g., by transitioning the waveguide hinge 3200A and the waveguide hinge 3200B into second relative rotational configurations. As is evident, this misaligns the portions of the waveguide that pass through the waveguide hinges 3200A and 3200B such that the waveguide is no longer configured to transport RF energy from the main body RF source 3262 to the RF component 3254. The antenna reflector 3242 may also be folded against the main body 3240, thereby placing the spacecraft into a more compact configuration that is suitable for stowage in a launch or delivery vehicle.

The waveguide hinges discussed herein may be made of various materials, although the interior surfaces of each RF waveguide portion, i.e., the surfaces that act to contain RF energy within the waveguide portions, may generally be made of an RF-reflective material, such as a metal, e.g., aluminum, steel, etc. In some implementations, the RF-reflective material may be applied as a coating or a layer on an RF-transparent material, such as a composite or plastic. It is also to be understood that the examples provided herein of waveguide hinges may be constructed in a number of different ways, and may include refinements or features not described in detail herein. For example, the first members and the second members discussed and depicted herein have generally been quite bulky, but in actual practice, such members may have significant amounts of material removed in order to lighten them. In some instances, such components may be manufactured using additive manufacturing techniques such as 3D printing, e.g., direct metal laser sintering, to allow for easy manufacture of potentially complex, curved RF waveguide portions.

In some implementations, the waveguide hinges discussed herein may be equipped with positive stops, spring-loaded detents, latches, or other locking mechanisms that may lock or engage when the first members and the second members are in the first relative rotational configuration and/or the second relative rotational configuration and that may prevent relative rotational movement of the first member and the second member when locked or engaged and permit such movement when unlocked/unlatched/unengaged.

In some other or additional implementations, the first member and the second member may be rotated with respect to one another by a motor, spring drive, or other type of motive mechanism.

Figure 33:
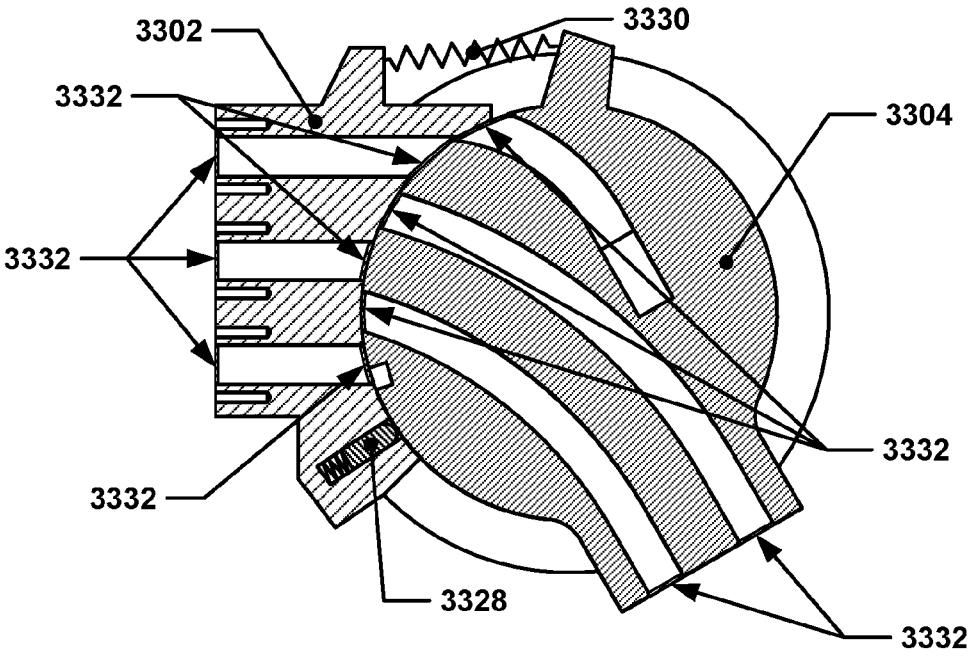
FIG. 33 shows a cross-sectional view of a waveguide hinge similar to that shown in FIG. 7 but with a locking mechanism.
Figure 34:
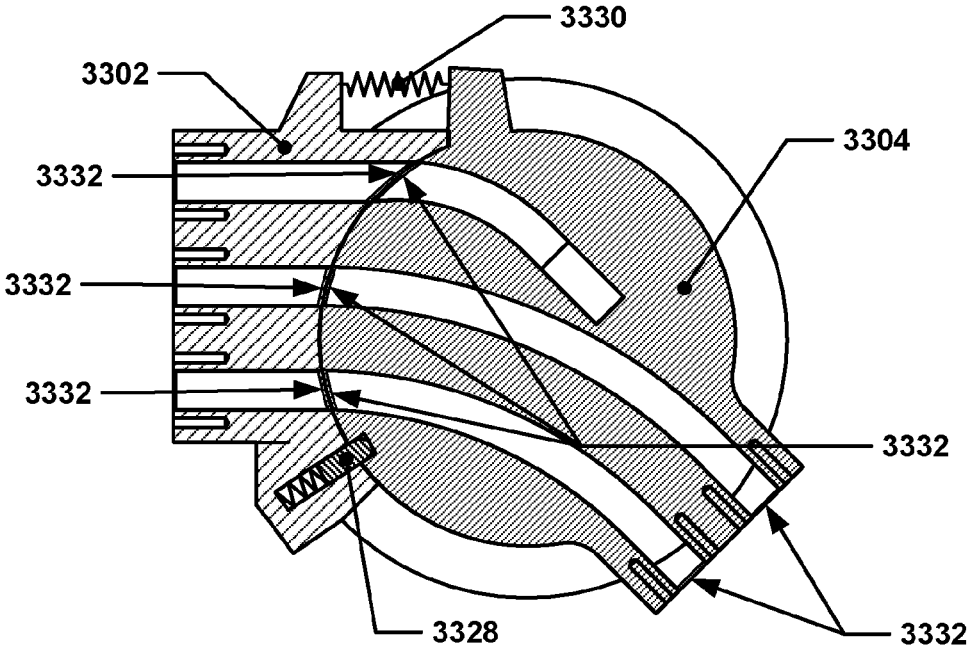
FIG. 34 shows a cross-sectional view of the waveguide hinge of FIG. 33 with the locking mechanism engaged.

FIG. 33 shows a cross-sectional view of a waveguide hinge similar to that shown in FIG. 7 but with a locking mechanism. FIG. 34 shows a cross-sectional view of the waveguide hinge of FIG. 33 with the locking mechanism engaged.

As can be seen, the waveguide hinge has a first member 3302 and a second member 3304; the first member 3302 includes a spring-loaded pin 3328 that serves as a locking mechanism. The second member 3304 may include a receptacle or recess sized to receive the spring-loaded pin 3328. When the first member 3302 and the second member 3304 are rotated into a first relative rotational configuration, as seen in FIG. 34, the spring-loaded pin 3328 may extend into the recess, thereby preventing further relative rotational movement.

Also shown in FIGS. 33 and 34 are a drive mechanism 3330, which is, in this example, a tension spring that acts to cause the first member 3302 and the second member 3304 to be biased towards the first relative rotational configuration. The waveguide hinge of FIGS. 33 and 34 also includes RF-permeable windows 3332, which are thin membranes or layers that seal off the waveguide portions within each member from contamination by dirt or other physical debris, but that permit RF energy to pass through with negligible attenuation.

It is to be understood that the above-described implementations may also be thought of in terms of rotary microwave coupling with a stationary member, i.e., a "stator," and a rotating member, i.e., a "rotor." The stator may, for example, be equivalent to the first member or the second member, and the rotor may, for example, be equivalent to the other of the first member or the second member. In such implementations, the stator may have a first waveguide port and the rotor may have a waveguide channel that passes through the rotor and that terminates at a second waveguide port on the rotor. The first waveguide port, the second waveguide port, and the waveguide channel may be generally disposed in a common plane. The coupling may also have a first waveguide that is coupled to the first waveguide port, and a second waveguide coupled to the second waveguide port. The coupling may be configured such that the rotor may rotate relative to the stator, and such that the second waveguide rotates with respect to the first waveguide about an axis perpendicular to the common plane when such rotation occurs.

In some such implementations, the rotation of the rotor relative to the stator may switch the apparatus between a first configuration and a second configuration. In the first configuration, a proximal end of the waveguide channel may be aligned with the first waveguide port, and in the second configuration, a proximal end of the waveguide channel may be disposed at a substantial angular offset about the axis from the first waveguide port.

Although several implementations have been described in detail herein with reference to the accompanying drawings, it is to be understood that this disclosure is not limited to these precise embodiments or implementations, and that various changes and modifications may be effected therein by one skilled in the art without departing from the scope or spirit of the disclosure as defined in the appended claims.

What is claimed is:

1. An apparatus, the apparatus comprising:

a first member;

a second member;

a first radio-frequency (RF) waveguide portion located within the first member; and a second RF waveguide portion located within the second member, wherein:

the first member and the second member are rotatably coupled with one another relative to a rotational axis, thereby forming a hinge, and are transitionable between a first relative rotational configuration and a second relative rotational configuration, in the first relative rotational configuration, the first RF waveguide portion and the second RF waveguide portion are aligned with one another to form a substantially continuous first waveguide through the first member and the second member, and in the second relative rotational configuration, the first RF waveguide portion and the second RF waveguide portion are not aligned with one another to form the substantially continuous first waveguide through the first member and the second member.

2. The apparatus of claim 1, wherein:

the first RF waveguide portion enters the first member along a direction substantially parallel to a first axis that is perpendicular to the rotational axis, and the second RF waveguide portion exits the second member along a direction substantially parallel to a second axis that is also perpendicular to the rotational axis.

3. The apparatus of claim 1, wherein:

the first RF waveguide portion enters the first member along a direction substantially parallel to a first axis that is perpendicular to the rotational axis, and the second RF waveguide portion exits the second member along a direction substantially parallel to the rotational axis.

4. The apparatus of claim 1, wherein the first RF waveguide portion enters the first member and the second RF waveguide portion enters the second member along directions substantially parallel to the rotational axis.

5. The apparatus of claim 1, further comprising:

a third RF waveguide portion located in the first member; and a fourth RF waveguide portion located in the second member, wherein:

the third RF waveguide portion and the fourth RF waveguide portion are aligned with one another to form a substantially continuous second waveguide through the first member and the second member when the first member and the second member are in the first relative rotational configuration, and the third RF waveguide portion and the fourth RF waveguide portion are not aligned with one another to form the substantially continuous second waveguide through the first member and the second member when the first member and the second member are in the second relative rotational configuration.

6. The apparatus of claim 5, wherein:

the first RF waveguide portion and the third RF waveguide portion enter the first member along directions substantially parallel to a first axis that is perpendicular to the rotational axis, and the second RF waveguide portion and the fourth RF waveguide portion exit the second member along directions substantially parallel to a second axis that is also perpendicular to the rotational axis.

7. The apparatus of claim 5, wherein:

the first RF waveguide portion and the third RF waveguide portion enter the first member along directions substantially parallel to a first axis that is perpendicular to the rotational axis, the second RF waveguide portion exits the second member along a direction that is substantially parallel to the rotational axis, and the fourth RF waveguide portion exits the second member along a direction substantially parallel to a second axis that is perpendicular to the rotational axis.

8. The apparatus of claim 1, further comprising a positive locking mechanism that locks when the first member and the second member are transitioned into the first relative rotational configuration and that prevents the first member and the second member from rotating relative to one another when locked.

9. The apparatus of claim 1, further comprising a drive mechanism, wherein the drive mechanism is configured to cause the apparatus to move from the second relative rotational configuration to the first relative rotational configuration.

10. The apparatus of claim 9, wherein the drive mechanism is an item selected from the group consisting of: a torsion spring, a linear spring, and a motor.

11. The apparatus of claim 1, wherein:

in the first relative rotational configuration, the first RF waveguide portion and the second RF waveguide portion provide a first path for RF energy, and the first RF waveguide portion and the second RF waveguide portion both have rectangular cross-sections in planes perpendicular to the first path that are substantially the same.

12. The apparatus of claim 11, wherein the rectangular cross-sections have an aspect ratio of between 1.8:1 and 2.2:1.

13. The apparatus of claim 1, further comprising:

a plurality of first RF waveguide portions located in the first member, wherein the plurality of first RF waveguide portions includes the first RF waveguide portion; and a plurality of second RF waveguide portions located in the second member, wherein the plurality of second RF waveguide portions includes the second RF waveguide portion, wherein:

each of the second RF waveguide portions corresponds to a corresponding one of the first RF waveguide portions, in the first relative rotational configuration, each of the first RF waveguide portions and each of the corresponding second RF waveguide portions are aligned with one another to form a corresponding substantially continuous waveguide through the first member and the second member, and in the second relative rotational configuration, each of the first RF waveguide portions and each of the second RF waveguide portions are not aligned with one another to form the corresponding substantially continuous waveguide through the first member and the second member.

14. The apparatus of claim 13, wherein:

one or more of the first RF waveguide portions enters the first member along a direction substantially parallel to a first axis that is perpendicular to the rotational axis, and one or more of the second RF waveguide portions exits the second member along a direction substantially perpendicular to a second axis that is also perpendicular to the rotational axis.

15. The apparatus of claim 13, wherein:

one or more of the first RF waveguide portions enters the first member along a direction substantially parallel to a first axis that is perpendicular to the rotational axis, and one or more of the second RF waveguide portions exits the second member along a direction substantially parallel to the rotational axis.

16. The apparatus of claim 13, wherein one or more of the first RF waveguide portions enters the first member and one or more of the second RF waveguide portions exits the second member along a directions substantially parallel to the rotational axis.

17. The apparatus of claim 13, wherein:

one or more of the first RF waveguide portions enters the first member along a direction substantially parallel to a first axis that is perpendicular to the rotational axis, one or more of the second RF waveguide portions exits the second member along a direction substantially parallel to a second axis that is also perpendicular to the rotational axis, and one or more of the second RF waveguide portions exits the second member along a direction substantially parallel to the rotational axis.

18. The apparatus of claim 1, further comprising:

a deployable boom having a distal end and a proximal end;

a boom RF waveguide; and a spacecraft main body having a main body RF source, wherein:

the proximal end of the deployable boom is connected with the second member and the boom RF waveguide is coupled with the second RF waveguide portion, the boom RF waveguide extends from the proximal end of the deployable boom towards the distal end of the deployable boom, the spacecraft main body is connected with the first member and the main body RF source is coupled with the first RF waveguide portion, and the first member and the second member are configured to allow the deployable boom to be rotated about the rotational axis from a stowed configuration to a deployed configuration, wherein the first member and the second member are in the first relative rotational configuration in the deployed configuration and in the second relative rotational configuration in the stowed configuration.

19. The apparatus of claim 1, further comprising a first RF routing panel and a spacecraft main body, wherein:

the first RF routing panel is mounted on or within the main body, the hinge formed by the first member and the second member is configured to allow the first RF routing panel to be rotated relative to the main body, in the first relative rotational configuration, the first RF routing panel is in a configuration in which RF components mounted to the first RF routing panel are operable to route RF power and the first waveguide is configured to route RF power from or to a first RF component of the RF components mounted to the first RF routing panel, the first RF component is connected to the first member, and in the second relative rotational configuration, the first RF routing panel is in a configuration in which the first waveguide is not operable to route RF power from or to the first RF component.

20. The apparatus of claim 19, further comprising a second RF routing panel having additional RF components mounted thereon, wherein:

a second RF component of the additional RF components is connected with the second member, when the first member and the second member are in the first relative rotational configuration:

the first waveguide is configured to route RF power between the first RF component and the second RF component, and the first RF routing panel and the second RF routing panel are substantially parallel to one another, and when the first member and the second member are in the second relative rotational configuration:

the first RF routing panel and the second RF routing panel are at a substantial angle to one another, and the first waveguide is not configured to route RF power between the first RF component and the second RF component.

21. An apparatus comprising;

a rotary microwave coupling, the rotary microwave coupling including a stator having (a) a first waveguide port and (b) a rotor having a rigid waveguide channel, a distal end of the rigid waveguide channel forming a second waveguide port, wherein the first waveguide port, the waveguide channel, and the second waveguide port are generally disposed in a common plane;

a first waveguide coupled with the first waveguide port; and a second waveguide coupled with the second waveguide port, wherein:

rotation of the rotor results in rotation of the second waveguide with respect to the first waveguide about an axis perpendicular to the common plane, the apparatus is transitionable between a first configuration and a second configuration through rotation of the rotor, a proximal end of the rigid waveguide channel is, in the first configuration, aligned with the first waveguide port such that the first waveguide, the first waveguide port, the rigid waveguide channel, the second waveguide port, and the second waveguide form a substantially continuous waveguide through the rotary microwave coupling, and the proximal end of the rigid waveguide channel is, in the second configuration, misaligned with the first waveguide port such that the first waveguide, the first waveguide port, the rigid waveguide channel, the second waveguide port, and the second waveguide do not form the substantially continuous waveguide through the rotary microwave coupling.

22. The apparatus of claim 21, wherein, in the second configuration, the proximal end of the rigid waveguide channel is disposed at a substantial angular offset about the axis from the first waveguide port.

* * * * *